US009549871B2

(12) United States Patent
Campbell

(10) Patent No.: US 9,549,871 B2
(45) Date of Patent: Jan. 24, 2017

(54) LIGHTED JETS FOR BATHING INSTALLATIONS

(75) Inventor: Graham J. Campbell, Stevenson Ranch, CA (US)

(73) Assignee: Balboa Water Group, Inc., Tustin, CA (US)

( * ) Notice: Subject to any disclaimer, the term of this patent is extended or adjusted under 35 U.S.C. 154(b) by 1172 days.

(21) Appl. No.: 13/436,672

(22) Filed: Mar. 30, 2012

(65) Prior Publication Data

US 2012/0192348 A1 Aug. 2, 2012
US 2016/0010832 A9 Jan. 14, 2016

Related U.S. Application Data

(63) Continuation of application No. 13/323,702, filed on Dec. 12, 2011, now abandoned, and a continuation-in-part of application No. 13/018,349, filed on Jan. 31, 2011, now abandoned.

(60) Provisional application No. 61/430,172, filed on Jan. 6, 2011.

(51) Int. Cl.

| | |
|---|---|
| ***A62C 5/00*** | (2006.01) |
| ***A61H 33/00*** | (2006.01) |
| ***F21V 15/01*** | (2006.01) |
| ***E03C 1/08*** | (2006.01) |
| *A61H 33/02* | (2006.01) |

(52) U.S. Cl.

CPC ..... *A61H 33/6063* (2013.01); *A61H 33/005* (2013.01); *A61H 33/0087* (2013.01); *A61H 33/601* (2013.01); *E03C 1/08* (2013.01); *F21V 15/01* (2013.01); *A61H 33/02* (2013.01); *A61H 2033/0083* (2013.01)

(58) Field of Classification Search

CPC ..... A61H 33/6063; A61H 33/0087; A61H 33/005; A61H 2033/0083; A61H 33/601; A61H 33/02; E03C 1/08; F21V 15/01

USPC ..... 362/96; 239/398

See application file for complete search history.

(56) References Cited

U.S. PATENT DOCUMENTS

| | | | | |
|---|---|---|---|---|
| 3,587,184 A | | 6/1971 | Walker, Jr. | |
| 5,014,372 A | * | 5/1991 | Thrasher | A61H 33/6057 239/414 |
| 5,045,978 A | | 9/1991 | Gargle | |
| 5,217,292 A | | 6/1993 | Chalberg | |
| 5,486,984 A | | 1/1996 | Miller | |
| 5,848,839 A | | 12/1998 | Savage, Jr. | |
| 6,094,754 A | | 8/2000 | Pinciaro | |

(Continued)

*Primary Examiner* — Arthur O Hall
*Assistant Examiner* — Joel Zhou
(74) *Attorney, Agent, or Firm* — Larry K. Roberts

(57) ABSTRACT

A lighted jet assembly for through hole mounting to a panel in a bathing installation. In an exemplary embodiment, the assembly includes a jet body configured for mounting in a hole formed in the bathing installation panel. A light receptacle is formed with the jet body, the light receptacle configured to receive a light source element. A jet barrel assembly includes a hollow barrel structure configured for insertion into the jet body channel through the open second end of the jet body. A blind structure includes a hollow cylindrical portion having at a first end a flange portion extending over a limited angular extent, and a second end configured to be secured within the open interior region of the jet barrel structure. The blind structure is fabricated of an opaque material, and configured for rotation with the jet barrel assembly relative to the jet body.

16 Claims, 20 Drawing Sheets

(56) References Cited

U.S. PATENT DOCUMENTS

| | | | | |
|---|---|---|---|---|
| 6,264,122 | B1 | 7/2001 | Perdreau et al. | |
| 6,322,004 | B1 | 11/2001 | Perdreau et al. | |
| 6,435,691 | B1 | 8/2002 | Macey | |
| 6,510,277 | B1 | 1/2003 | Dongo | |
| 6,595,675 | B2 | 7/2003 | Dongo | |
| 6,702,451 | B1 * | 3/2004 | Daane | A61H 33/6063 222/113 |
| 6,848,637 | B2 | 2/2005 | Holtsnider | |
| 6,886,958 | B1 | 5/2005 | Grant | |
| 6,942,354 | B2 | 9/2005 | Metayer et al. | |
| 6,968,581 | B2 | 11/2005 | Christensen | |
| 6,973,681 | B2 | 12/2005 | Ayeni et al. | |
| 7,073,916 | B2 | 7/2006 | Yin | |
| 7,722,216 | B2 | 5/2010 | Amor | |
| 8,042,962 | B2 | 10/2011 | Fuentes | |
| 8,408,728 | B2 | 4/2013 | Fuentes | |
| 8,550,643 | B2 | 10/2013 | Kownacki | |
| 8,756,723 | B2 * | 6/2014 | Loyd | B05B 1/3026 4/541.6 |
| 2006/0002104 | A1 | 1/2006 | Willis | |
| 2006/0002105 | A1 * | 1/2006 | Hinojosa, Jr. | A61H 33/027 362/101 |
| 2009/0106890 | A1 | 4/2009 | Rosenau | |
| 2009/0219708 | A1 * | 9/2009 | Fuentes | F21V 33/004 362/96 |

* cited by examiner

LIGHTED JETS FOR BATHING INSTALLATIONS

CROSS-REFERENCE TO RELATED APPLICATION

This application claims the benefit of U.S. Provisional Application No. 61/430,172 filed Jan. 6, 2011; U.S. application Ser. No. 13/018,349, filed Jan. 31, 2011; and of U.S. application Ser. No. 13/323,702 filed Dec. 12, 2011, the entire contents of which are hereby incorporated by reference. This application is a continuation-in-part of application Ser. No. 13/018,349, which in turn claims priority from U.S. Provisional application No. 61/430,172, filed Jan. 6, 2011, and is a continuation of application Ser. No. 13/323,702.

BACKGROUND

Bathing installations such as whirlpool baths, spas and pools may include one or more fittings passed through an opening in the wall or surface of bathing installations, e.g., a wall or surface of a water receptacle such as a tub or pool. The fittings may be for water and/or air jets. It may be desirable to provide the jets with lighting.

BRIEF DESCRIPTION OF THE DRAWINGS

Features and advantages of the disclosure will readily be appreciated by persons skilled in the art from the following detailed description when read in conjunction with the drawing wherein:

FIGS. 1A-2C illustrate an exemplary embodiment of a lighted jet assembly for a bathing installation. FIGS. 1A and 1B are respective isometric rear and front views of the assembly as mounted in a wall panel of a bathing installation tub.

FIG. 2C is an exploded rear isometric view, with the barrel and escutcheon assembly shown in exploded view relative to the jet body assembly.

DETAILED DESCRIPTION

Figure 1A:
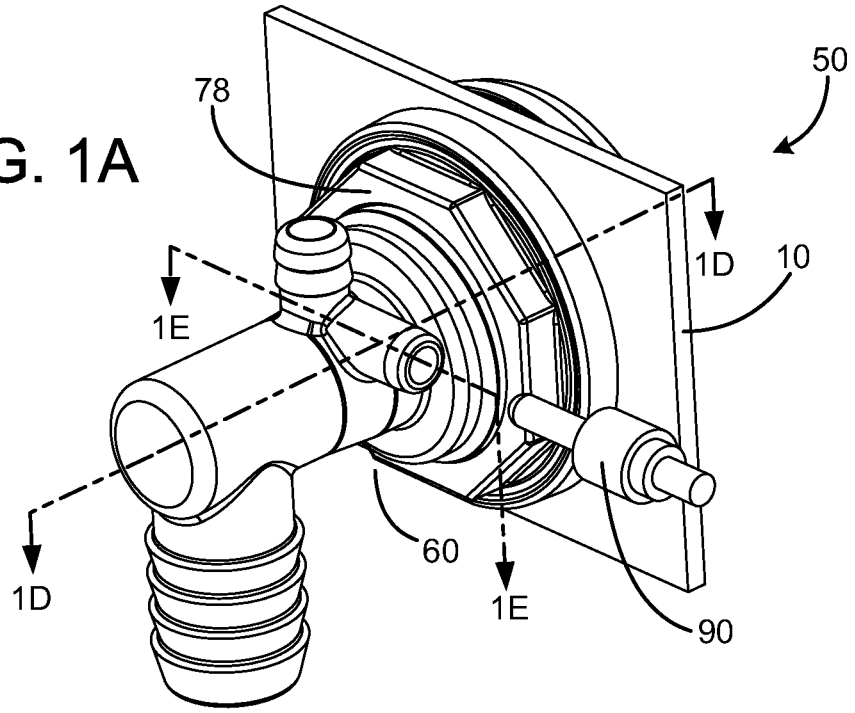
Figure 1B:
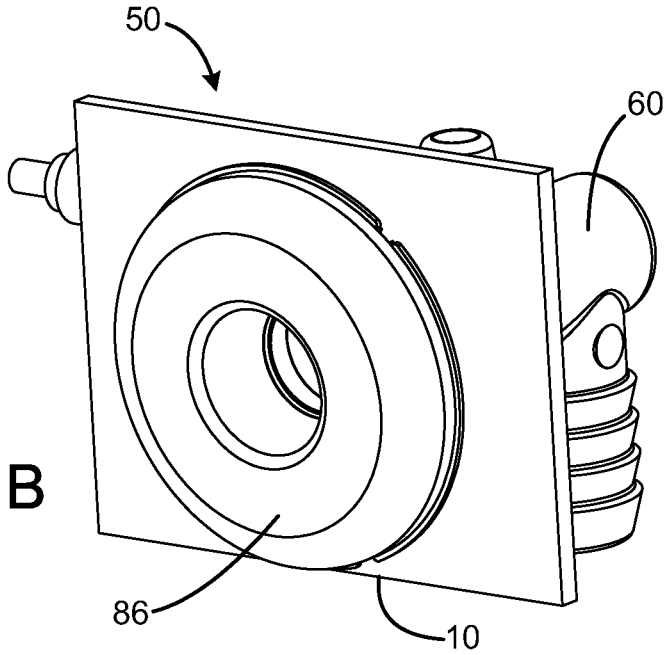
Figure 1C:
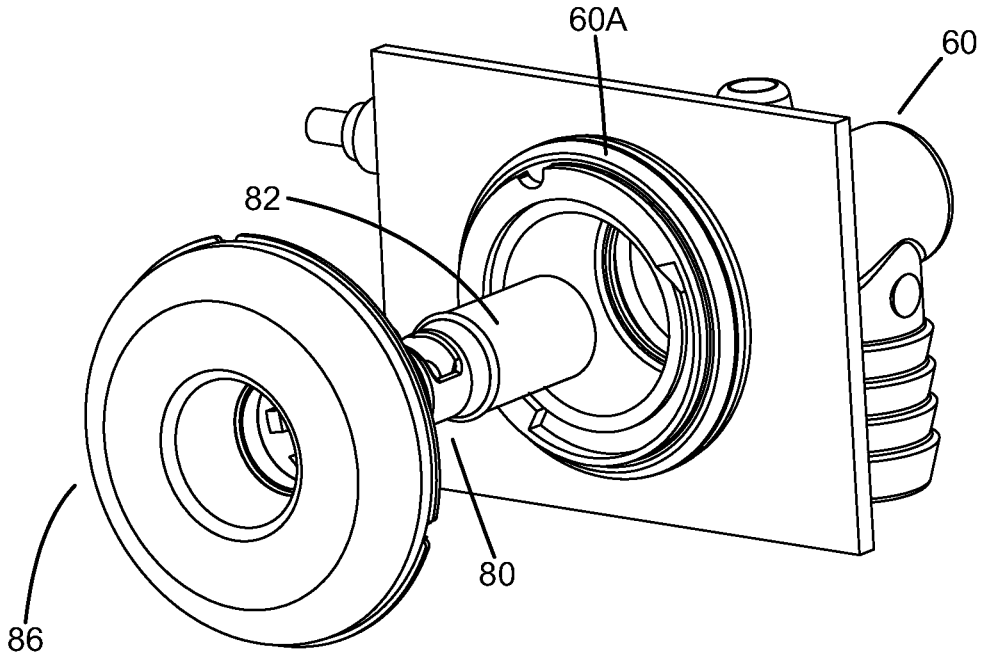
FIG. 1C is an exploded front isometric view, with the barrel and escutcheon assembly shown in exploded view relative to the jet body assembly.
Figure 1D:
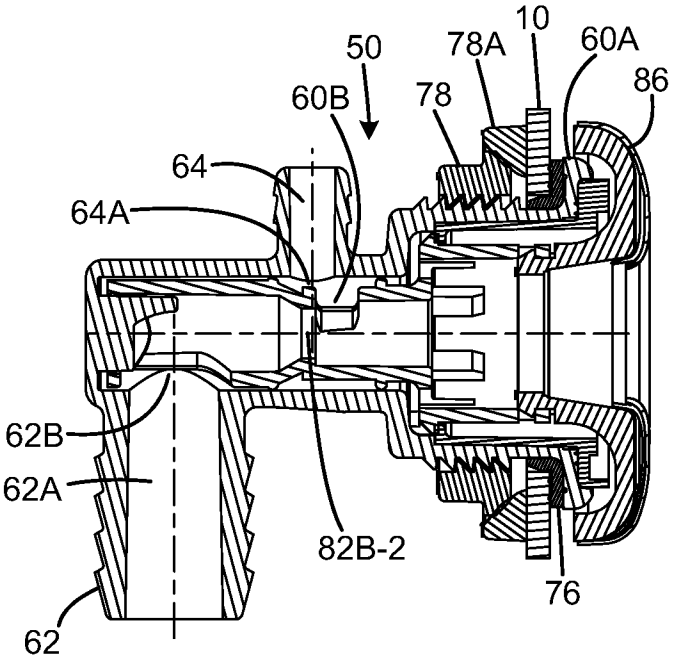
FIG. 1D is a cross-sectional view taken along line 1D-1D of FIG. 1A.

In the following detailed description and in the several figures of the drawing, like elements are identified with like reference numerals. The figures may not be to scale, and relative feature sizes may be exaggerated for illustrative purposes.

An exemplary embodiment of a lighted jet assembly 50 adapted for through-hole mounting in a panel or wall is illustrated in FIGS. 1A-2C. An exemplary application for the fixture assembly is for mounting in a tub wall 10 of a bathing installation such as a spa or whirlpool bath.

The exemplary jet assembly 50 includes a jet body 60 fabricated from a translucent or transparent material such as clear ABS, clear PVC, clear acrylic or clear polycarbonate. In an exemplary embodiment, the jet body is an integral one-piece structure, and includes a water inlet port nipple 62 formed at one end of the jet body, and a flange portion 60A formed at the opposite end of the jet body. The flange portion has an outer diameter larger than the opening formed in the tub wall 10. The water inlet nipple 62 has a passageway 62A in fluid communication with the jet body internal open channel or plenum 60B. The water inlet nipple is configured for connection to a water line connected to a bathing installation pump, so that water may be pumped through the jet into the tub. The jet body flares outwardly to form a jet body cavity 60C of larger diameter than that of cavity 60B, which receives the central portion of the escutcheon and any jet fitting such as an eyeball or other water-directing feature, examples of which are well known in the bathing installation art.

A threaded nut 78 is configured to be threaded onto a threaded region 66 of the jet body 60, and secure the jet body 60 in place against the wall 10 by drawing the flange portion tightly against the wall. A gasket 76 or sealing compound may be used between the flange portion and the wall to provide a water tight seal. A compensating ring 78A with a beveled surface may be used for some applications between the nut 78 and the wall 10, to compensate for undulations in the tub wall.

The jet body 60 further includes an air inlet nipple 64 and a light receptacle nipple 66 formed integrally with the body. The air inlet nipple 64 defines a passageway 64A in fluid communication with opening 64B formed through the jet body. The air inlet nipple 64 is configured for tubing connection to an air source or air pump. For example, the nipple 64 may be connected to the atmosphere through a valve. This allows the water flowing through the jet to be conditioned with air bubbles entrained in the water flow.

The light receptacle nipple 68 has a passageway 68A formed therein to provide a receptacle, which terminates in the jet body wall 60C. A light source 90 such as an incandescent bulb, LED or optical fiber connected to a remotely located light source is disposed in the light receptacle. It will be apparent that light emitted by light source 90 installed in the nipple receptacle will pass through the jet body wall 60C, if the jet body is fabricated of a transparent or translucent material.

In this exemplary embodiment, which may be for a two inch nominal diameter jet assembly, the air inlet 64A to the jet body and the light inlet 68A within the nipple 68 are defined at substantially the transverse plane defined through the jet body 60.

The jet assembly 50 further includes a jet barrel assembly 80. The assembly 80 includes a barrel structure 82 which is configured for insertion into the jet body channel 60B, and an escutcheon 86 which is attached to a first end portion 82A of the barrel structure 82, e.g. by one or more clip portions 86A-1 formed on hollow boss 86A, and which snap-fits into a corresponding slot 82A-1 formed in the barrel end portion 82A. In an exemplary embodiment, the barrel 82 is fabricated of an opaque material, such as ABS or PVC. The escutcheon 86 can be fabricated of an opaque or a transparent or translucent material, such as clear or opaque ABS, polycarbonate, acrylic or ASA (as an opaque material).

By rotating the escutcheon 86, the barrel 82 can be rotated within the jet body. In this exemplary embodiment, rotation of the barrel 82 not only controls the flow of water and air through the jet, but also controls the amount of light transmitted into the barrel from the light source 90. This feature can provide a visual indication, in this example, of the state of the jet operation. With water and air turned off, the amount of light entering the barrel is also turned off or substantially attenuated; with water and air turned on, the amount of light entering the barrel is increased substantially. These features are described more fully below.

Figure 1E:
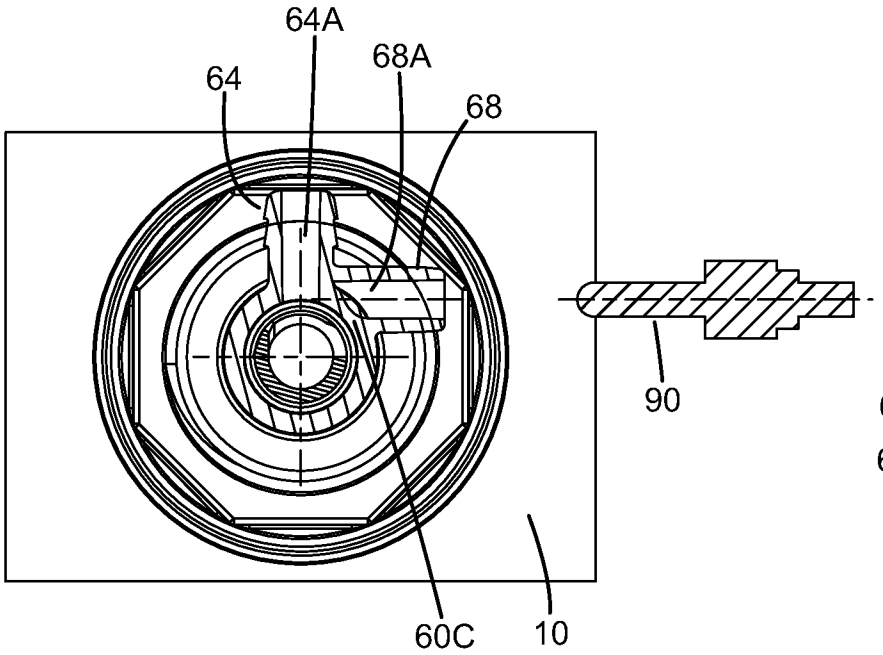
FIG. 1E is a cross-sectional view taken along line 1E-1E of FIG. 1A.
Figure 2A:
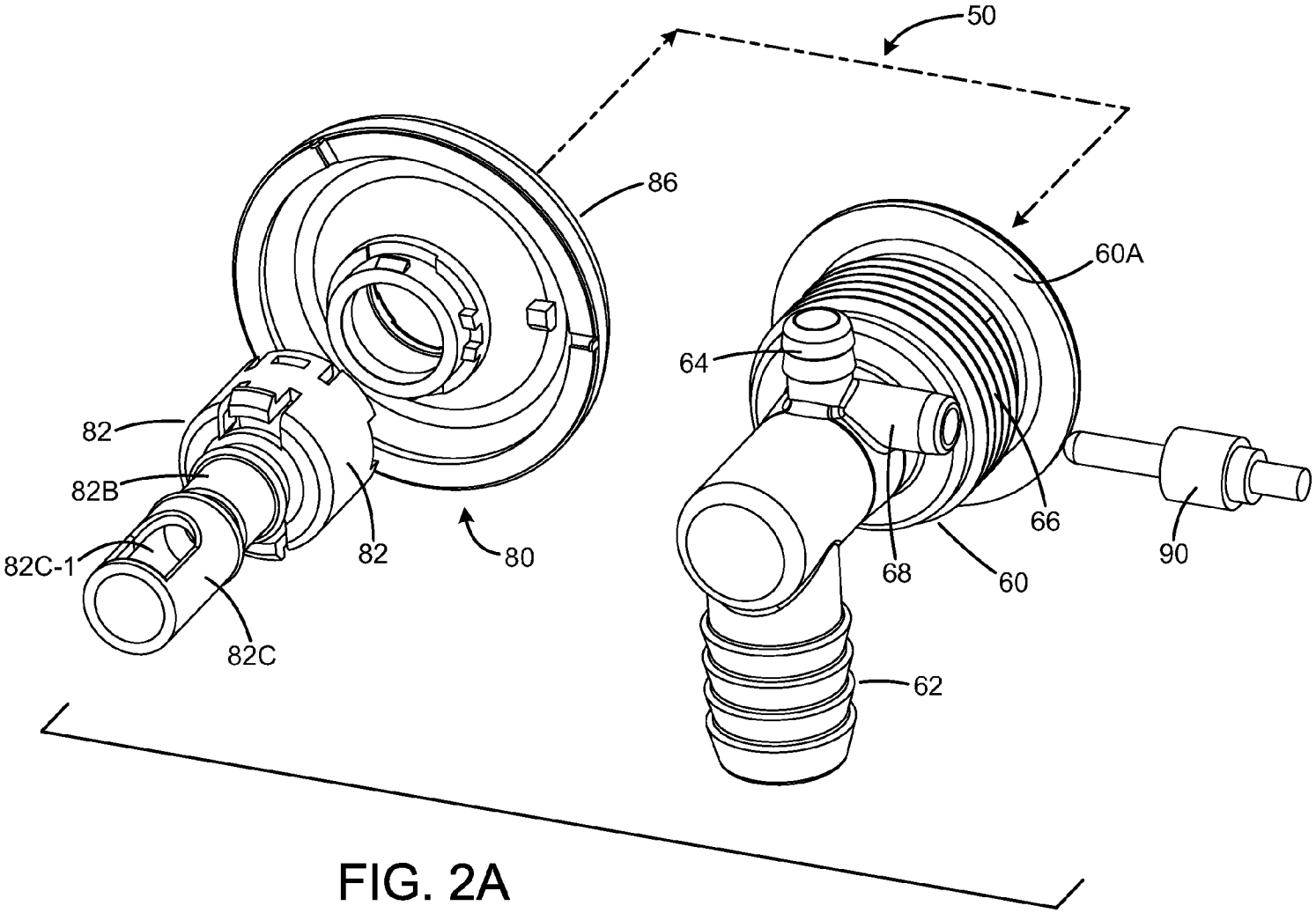
FIGS. 2A and 2B are respective exploded rear and front isometric views of the barrel and escutcheon assembly with the jet body and light emitter.
Figure 2B:
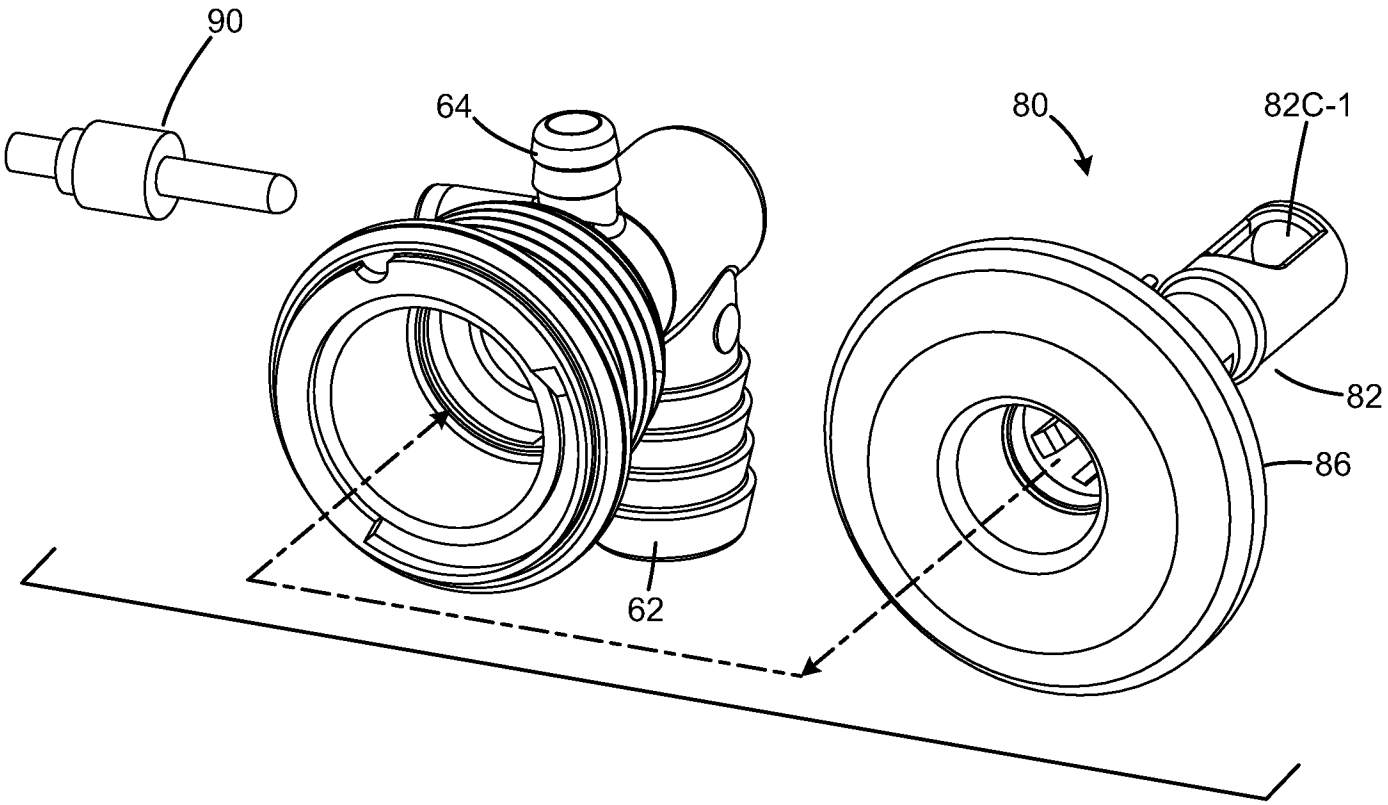
Figure 2C:
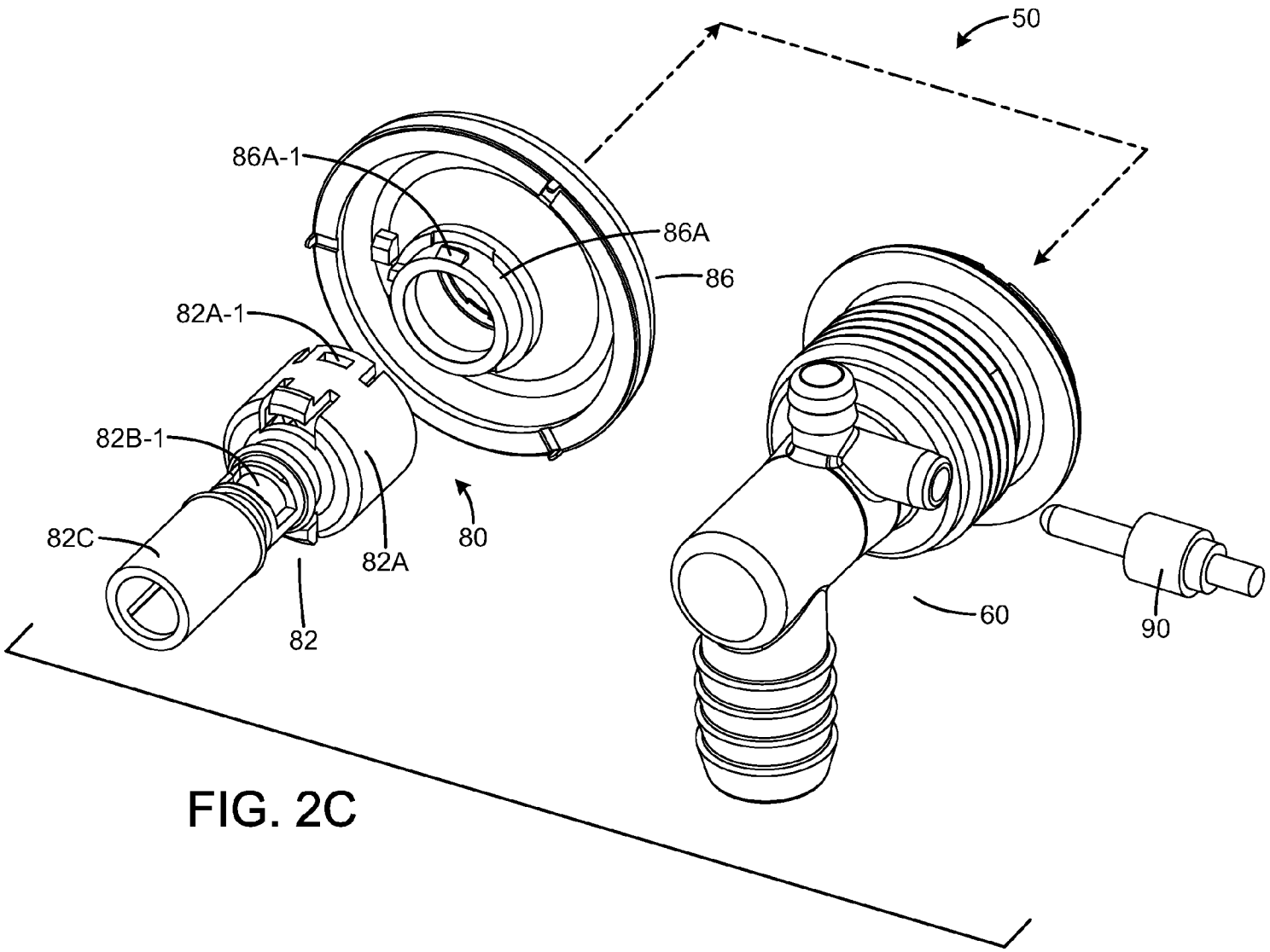

The barrel 82 has an intermediate portion 82B and a second end portion 82C. The second end portion 82C is configured for insertion into the jet body channel 60B (FIG. 1D), and has a window or opening 82C-1 formed therein. With the barrel rotated to a position in which the window 82C-1 is aligned with the port 62B in the jet body, water is allowed to enter the barrel and pass through the jet into the tub. This open position is illustrated in FIG. 1E and 2C. With the barrel rotated to the off position, shown in FIGS. 1C and 2A, the window 82C-1 is 180 degrees from the port 82B in the jet body, and water is substantially prevented from flowing into the jet body by the blocking, barrel portion 82C. There may be some water trickling into the jet body in the closed position, since the barrel portion 82C need not form a water-tight seal.

The intermediate portion 82B of barrel structure 82 tapers to a reduced diameter from that of the second end portion 82C, forming a venturi region 82B-2 in the intermediate portion. A second window or opening 82B-1 is formed in the intermediate portion of the barrel 82. The air port 64A formed in the jet body is disposed at or just downstream of the venturi region, providing a reduction in fluid pressure to draw in air from the air port 64A and through the window 82B-1 when the barrel is positioned to the open position, which is shown in FIGS. 1E and 2C. The window 82B-1 is aligned with the air port 64A in this open position. With the barrel rotated (180 degrees in this embodiment) from the open position to the off position, the window is oriented away from the air port 64A, and the wall of the center portion 82B blocks the air port.

In this exemplary embodiment, the window 82B-1 which controls the amount of air entering the jet barrel also controls the amount of light entering the barrel from light source 90 in receptacle 68. The light mounting receptacle is co-located, relative to the longitudinal axis of the jet body and barrel, with the air nipple and directly adjacent the air nipple. Since the jet body in this embodiment is fabricated of a transparent or translucent material, the light emitted from element 90 passes into the jet body at or adjacent the air nozzle opening 64A. The position of the window 82B-1 formed in the opaque barrel will control the amount of light passed from the emitter 90 into the interior of the barrel as well as the amount of air. In the open position, light passes through the window 82B-1. In the closed position, the opaque barrel will block light from passing directly into the barrel. Using the same window to control the light as to control the air flow avoids the effect on water flow that a separate window for light control may cause in a relatively small, short jet assembly.

Other exemplary embodiments of a lighted jet assembly are illustrated in FIGS. 3A-6B. For larger diameter jet assemblies, which may have a larger depth dimension than the exemplary jet assembly of FIGS. 1A-2C, a light window may be formed in the barrel structure which is displaced downstream of the venturi regions in the barrel and from the air window. One such jet assembly 150 is shown in exploded views, FIGS. 3A-3B. The jet assembly includes a jet body 160, again with a water inlet nipple 162, an air inlet nipple 164 and a light receptacle nipple 168. The jet body 160 may be formed of a transparent or translucent material, as described above regarding jet body 60. In this embodiment, however, the light receptacle nipple is located downstream of the air inlet nipple, closer to the flange portion 160A of the jet body than the air inlet nipple, and therefore increasing the intensity of light transmitted to the bather.

Figure 3A:
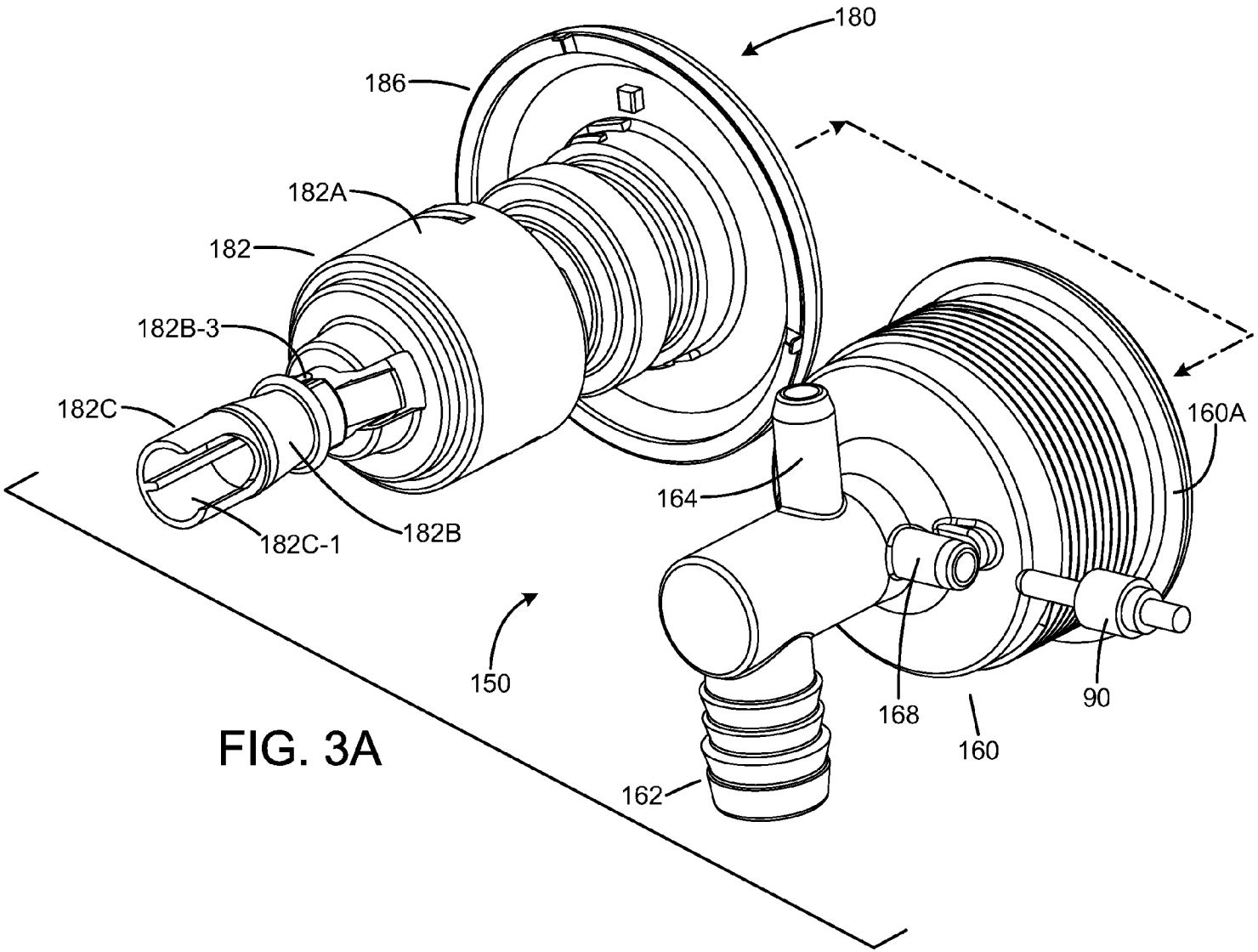
FIGS. 3A-3B are exploded front and rear isometric views of a second exemplary embodiment of a lighted jet assembly for a bathing installation.
Figure 3B:
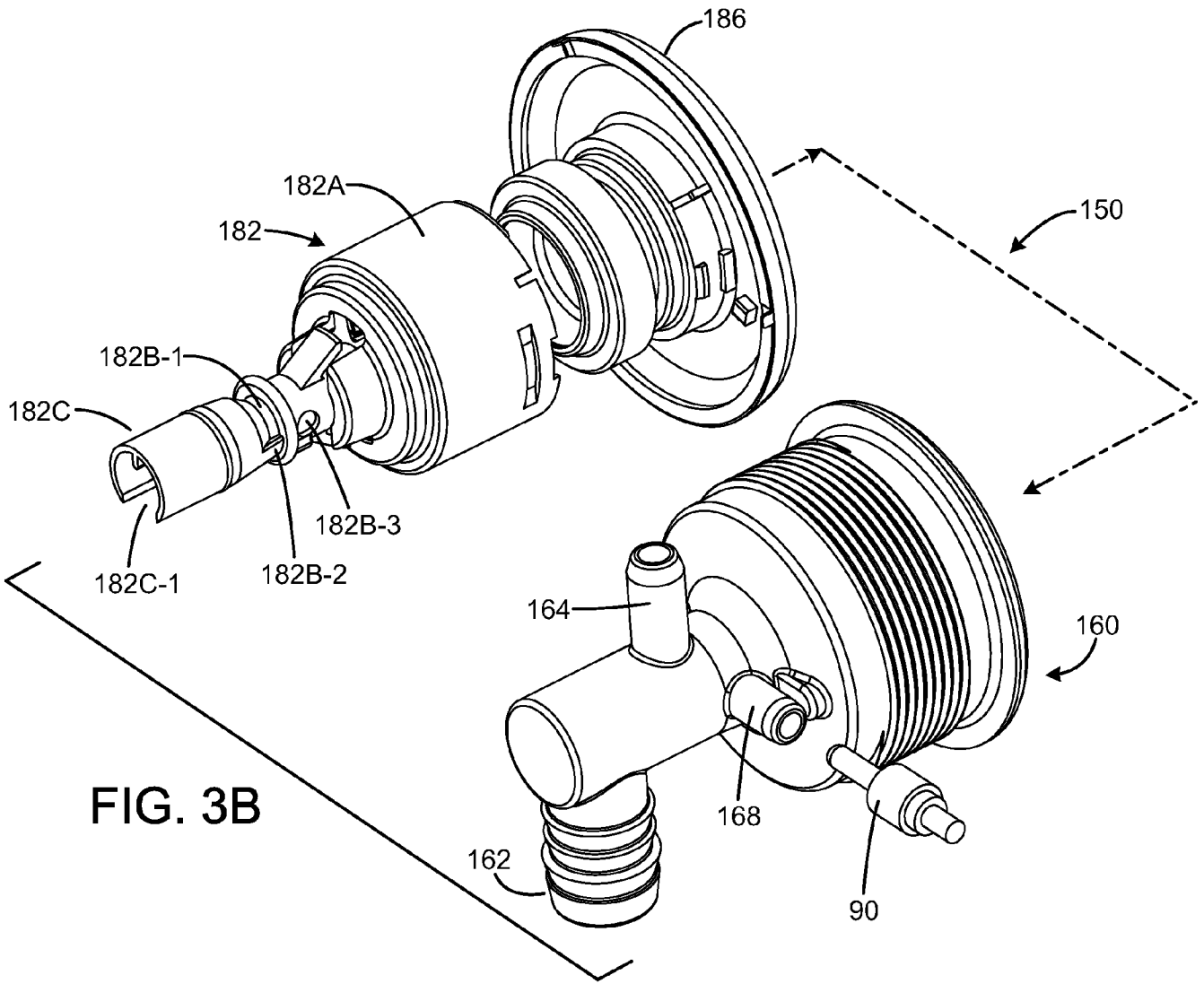

Still referring to FIGS. 3A-3B, the jet assembly 150 includes the barrel/escutcheon assembly 180, including barrel structure 182 and escutcheon 186 assembled together in similar fashion to that described above regarding jet assembly 50. The barrel structure 182 is fabricated of an opaque material, as described above regarding barrel structure 82. The assembly 180 is configured for insertion of the barrel portion 182C into the jet body 160. The barrel structure includes a window or opening 182C-1 in portion 182C, which allows water to flow from the water source through water inlet nipple 162 into the interior passageway of the barrel structure and out the jet assembly, when the barrel 182 is rotated to the open position (shown in FIG. 3B) in which the window 182C-1 is aligned with the nipple 162. The barrel structure 182 also includes an air inlet window 182B-1 located at or adjacent the venturi region 182B-2, and a separate light window 182B-3 located downstream of the venturi region (so as not to disturb the water flow through the venturi region). In the open position of the barrel, the window 182B-1 is also aligned with the air nipple 164 of the jet body, and the window 182B-3 is aligned with the light receptacle nipple 168. Thus, in the open position of the barrel/escutcheon assembly 180, water, air and light are all passed into the interior chamber of the barrel. From the tub interior, the jet assembly is lighted with light passing into the barrel and visible through the center opening of the escutcheon and the escutcheon itself if transparent.

The closed position of the barrel/escutcheon assembly is illustrated in FIG. 3A, with the barrel openings 182C-1, 182B-1 and 182B-3 all rotated 90 degrees counterclockwise from the open position, out of alignment with the corresponding nipple 162, 164 and 168. In this closed position, water and air flow is substantially turned off, and the opaque barrel prevents light from passing into the interior of the barrel, substantially turning off or attenuating visible light paths from the light source 90 into the barrel.

Figure 4A:
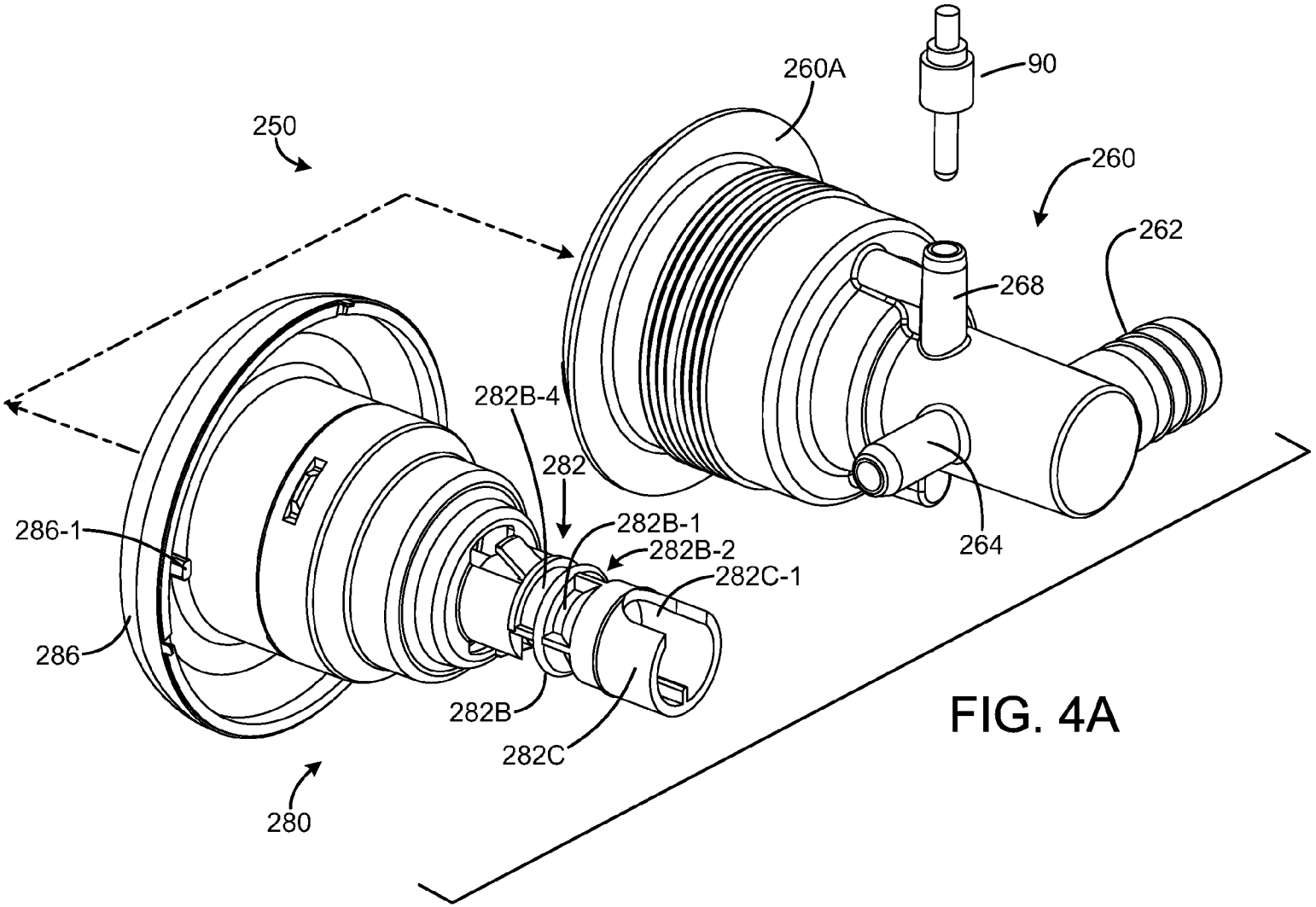
FIGS. 4A-4B are exploded front and rear isometric views of a third exemplary embodiment of a lighted jet assembly for a bathing installation.
Figure 4B:
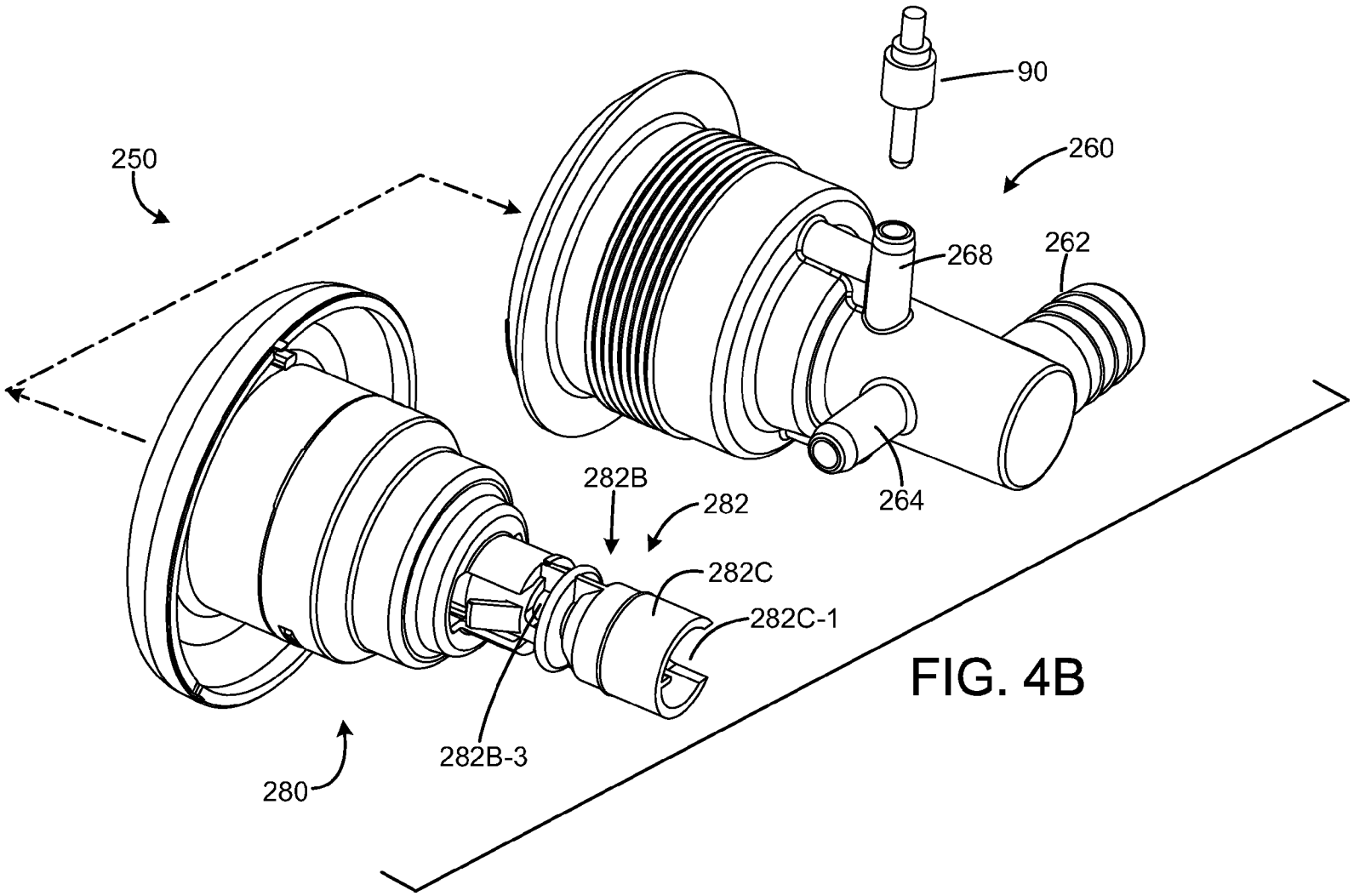

Another embodiment of a light jet assembly 250 is shown in FIGS. 4A-4B. The jet assembly includes a jet body 260, again with a water inlet nipple 262, an air inlet nipple 264 and a light receptacle nipple 268. The jet body 260 may be formed of a transparent or translucent material, as described above regarding jet body 60. The light receptacle nipple 268 is located downstream of the air inlet nipple, closer to the flange portion 260A of the jet body than the air inlet nipple.

Still referring to FIGS. 4A-4B, the jet assembly 250 includes the barrel/escutcheon assembly 280, including barrel structure 282 and escutcheon 286 assembled together in similar fashion to that described above regarding jet assembly 50. The barrel structure 260 is fabricated of an opaque material, as described above regarding barrel structure 60. The assembly 280 is configured for insertion of the barrel portion 282C into the jet body 260. The barrel structure includes a window or opening 282C-1 in portion 282C, which allows water to flow from the water source through water inlet nipple 262 into the interior passageway of the barrel structure and out the jet assembly, when the barrel 282 is rotated to the open position (shown in FIG. 4B) in which the window 282C-1 is aligned with the nipple 262. The barrel structure 282 also includes an air inlet window 282B-1 located at or adjacent the venturi region 282B-2, and a separate light window 282B-3 located downstream of the venturi region (so as not to disturb the water flow through the venturi region). In the open position of the barrel, the window 282B-1 is also aligned with the air nipple 264 of the jet body, and the window 282B-3 is aligned with the light receptacle nipple 268. Thus, in the open position of the barrel/escutcheon assembly 280, water, air and light are all passed into the interior chamber of the barrel. From the tub interior, the jet assembly is lighted with light passing into the barrel and visible through the center opening of the escutcheon and the escutcheon itself if transparent.

The closed position of the barrel/escutcheon assembly is illustrated in FIG. 4A, with the barrel openings 282C-1, 282B-1 and 282B-3 all rotated 90 degrees counterclockwise from the closed position, out of alignment with the corresponding nipple 262, 264 and 268. In this closed position, water and air flow is substantially turned off, and the opaque barrel prevents light from passing into the interior of the barrel, substantially turning off or attenuating visible light paths from the light source 90 into the barrel. Opaque barrel portion 282B-4 identified in FIG. 4A blocks light from the source 90 from entering the interior of the barrel.

The escutcheon 286 may be provided with a timing tab 286-1 (FIG. 4A) which interacts with corresponding stop surfaces (not visible in FIG. 4A) formed on the jet body rim, to define the closed and open positions of the escutcheon/barrel assembly relative to the jet body. One stop surface locates the closed position, and the other surface locates the open position. The escutcheon/barrel assembly may be rotated by the user between these positions.

Figure 5A:
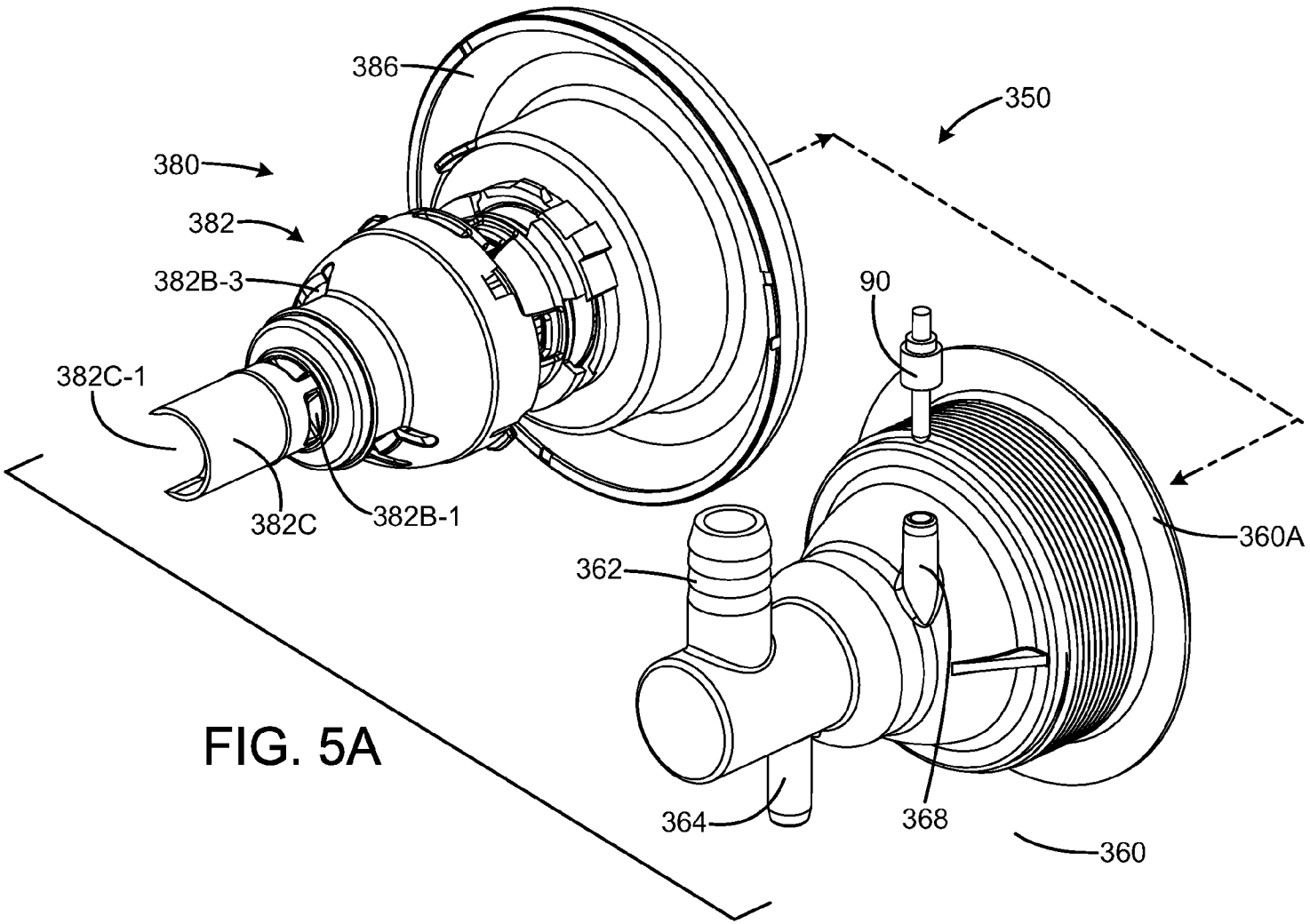
FIGS. 5A-5B are exploded front and rear isometric views of a fourth exemplary embodiment of a lighted jet assembly for a bathing installation.
Figure 5B:
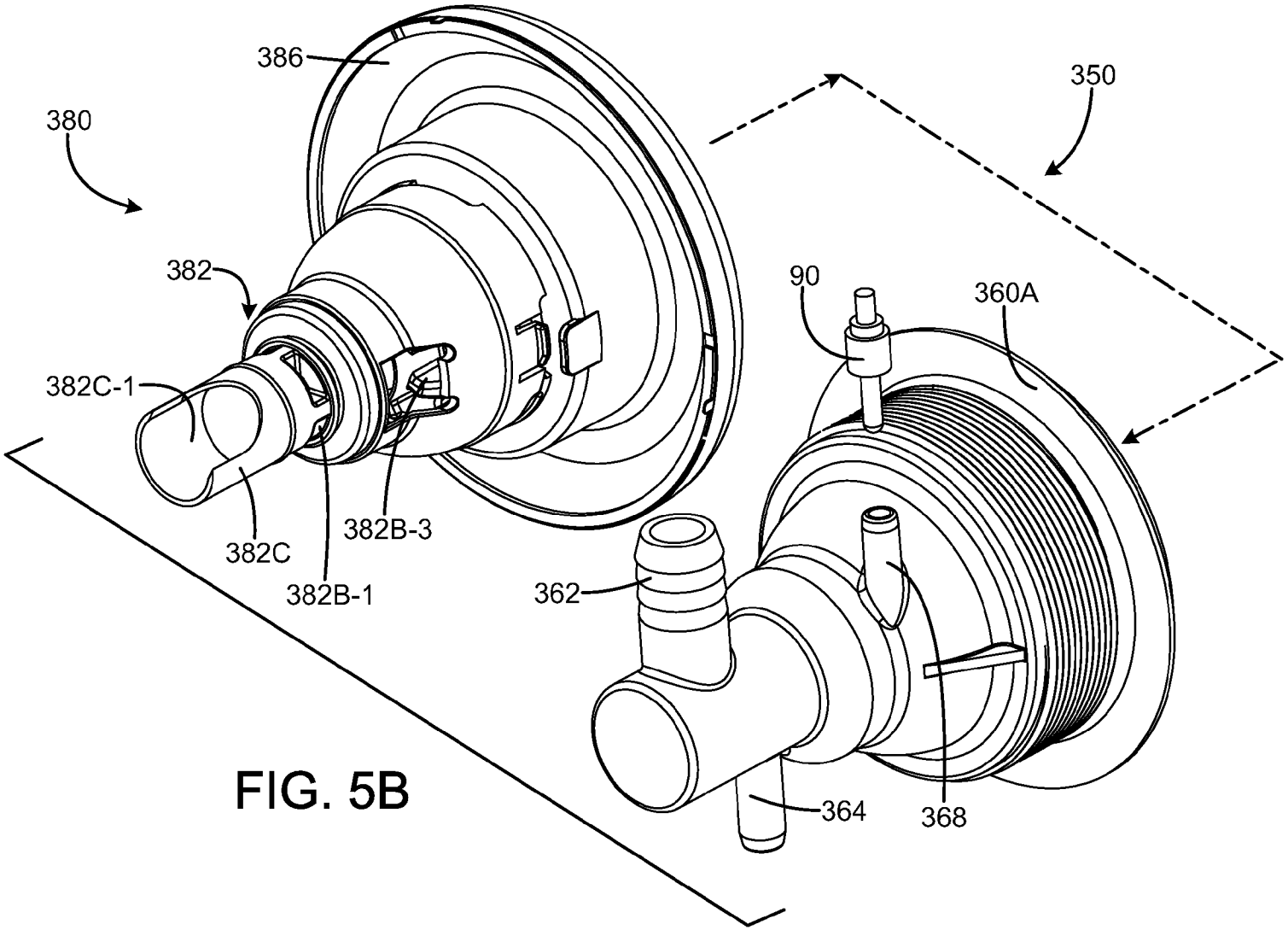

Another embodiment of a light jet assembly 350 is shown in FIGS. 5A-5B. The jet assembly includes a jet body 360, again with a water inlet nipple 362, an air inlet nipple 364 and a light receptacle nipple 368. The jet body 360 may be formed of a transparent or translucent material, as described above regarding jet body 60. The light receptacle nipple 368 is located downstream of the air inlet nipple, closer to the flange portion 360A of the jet body than the air inlet nipple.

Still referring to FIGS. 5A-5B, the jet assembly 350 includes the barrel/escutcheon assembly 380, including barrel structure 382 and escutcheon 386 assembled together in similar fashion to that described above regarding jet assembly 50. The barrel structure 382 may be fabricated of an opaque material, as described above regarding barrel structure 82. The assembly 380 is configured for insertion of the barrel portion 382C into the jet body 360. The barrel structure includes a window or opening 382C-1 in portion 382C, which allows water to flow from the water source through water inlet nipple 362 into the interior passageway of the barrel structure and out the jet assembly, when the barrel 382 is rotated to the open position (shown in FIG. 5B) in which the window 382C-1 is aligned with the nipple 362. The barrel structure 382 also includes in this exemplary embodiment four air inlet windows 382B-1 located at or adjacent the venturi region, and a separate light window 382B-3 located downstream of the venturi region. In the open position of the barrel, the window 382B-1 is also aligned with the air nipple 364 of the jet body, and the window 382B-3 is aligned with the light receptacle nipple 368. Thus, in the open position of the barrel/escutcheon assembly 380, water, air and light are all passed into the interior chamber of the barrel. From the tub interior, the jet assembly is lighted with light passing into the barrel and visible through the center opening of the escutcheon and the escutcheon itself if transparent.

The closed position of the barrel/escutcheon assembly is illustrated in FIG. 5A, with the barrel openings 382C-1, 382B-1 and 382B-3 all rotated 90 degrees counterclockwise from the open position, out of alignment with the corresponding nipple 362, 364 and 368. In this closed position, water flow is substantially turned off, and the opaque barrel prevents light from passing into the interior of the barrel, substantially turning off or attenuating visible light paths from the light source 90 into the barrel. Since there are four air windows formed in the barrel, the air path to an air source is not turned or blocked in this example with the barrel turned to the closed position.

Figure 6A:
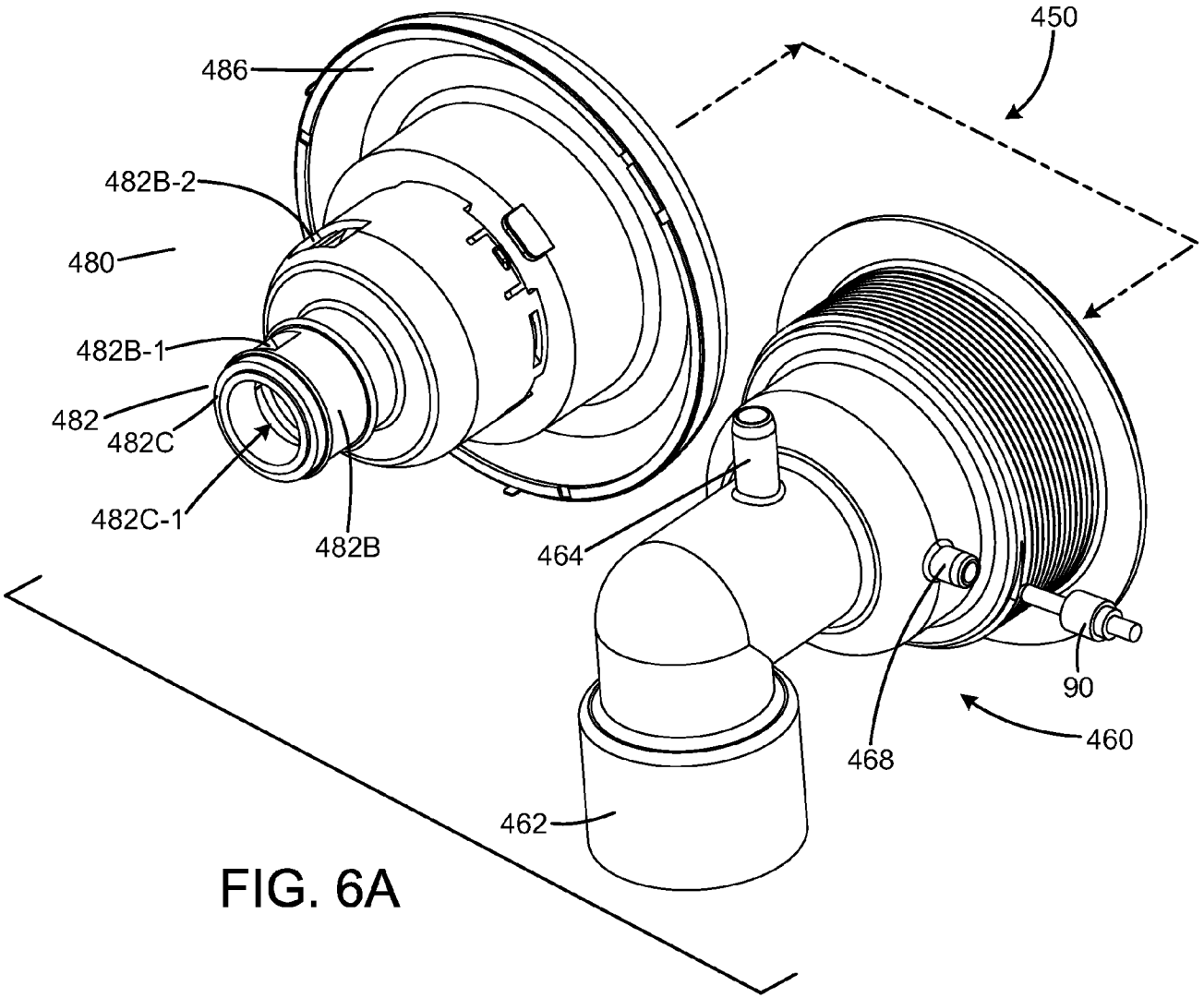
FIGS. 6A-6B are exploded front and rear isometric views of a fifth exemplary embodiment of a lighted jet assembly for a bathing installation.
Figure 6B:
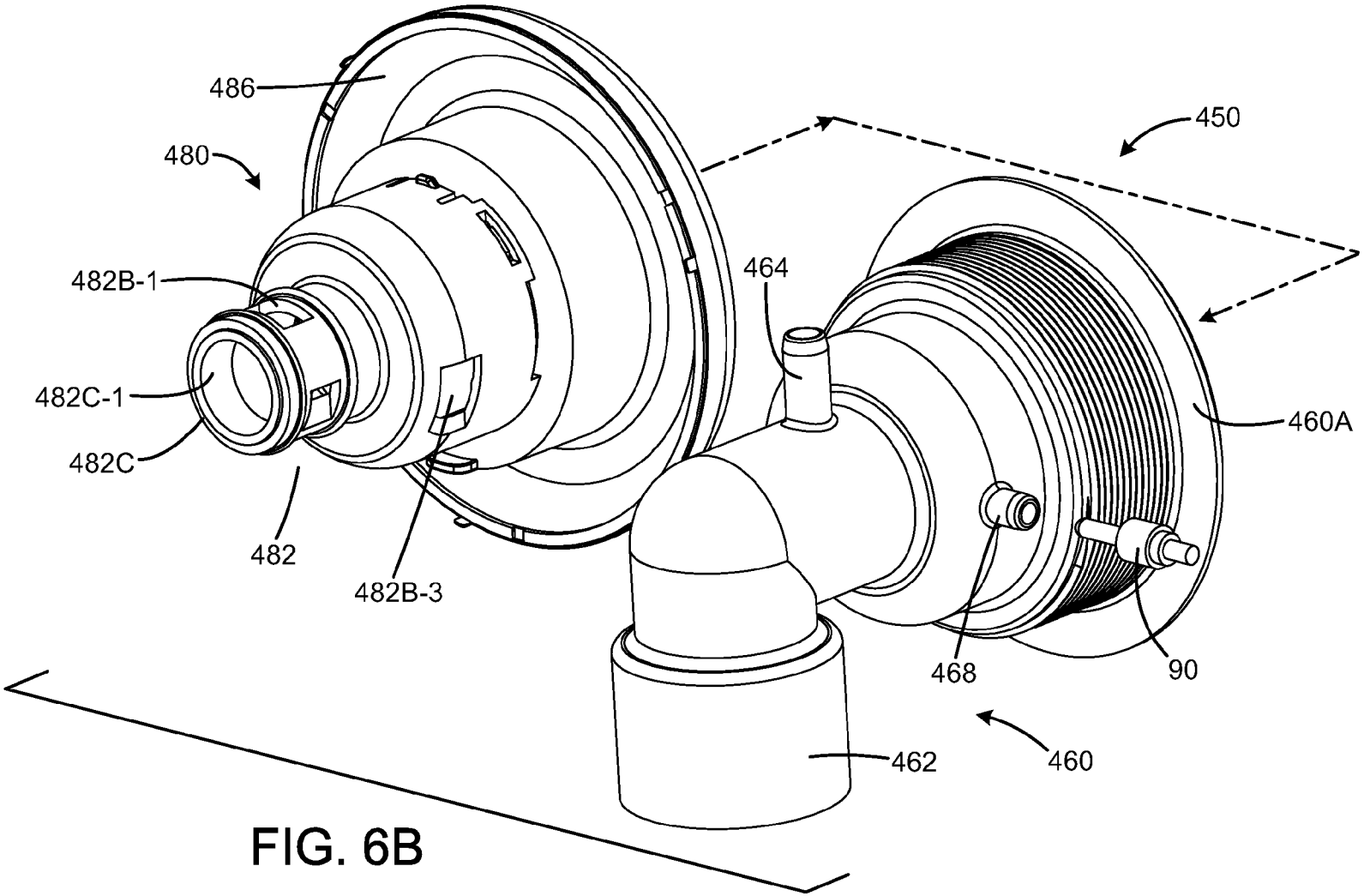

Various combinations of light/air/water control in a jet assembly may be achieved in other embodiments. FIGS. 6A-6B illustrate a jet assembly 450 in which the jet assembly does not provide for water control, and allows for air and light control by rotation of the barrel/escutcheon assembly 480. The jet assembly includes a jet body 460, with a right angle water inlet port 462, an air inlet nipple 464 and a light receptacle nipple 468. The jet body 460 may be formed of a transparent or translucent material, as described above regarding jet body 60. The light receptacle nipple 468 is located downstream of the air inlet nipple, closer to the flange portion 460A of the jet body than the air inlet nipple.

Still referring to FIGS. 6A-6B, the jet assembly 450 includes the barrel/escutcheon assembly 480, including barrel structure 482 and escutcheon 486 assembled together in similar fashion to that described above regarding jet assembly 50. The barrel structure 482 may be fabricated of an opaque material, as described above regarding barrel structure 82. The assembly 480 is configured for insertion of the barrel portion 482C into the jet body 460. The barrel structure includes an opening 482C-1, which allows water to flow from the water source through water inlet port 462 into the interior passageway of the barrel structure and out the jet assembly at all times. The barrel structure 482 also includes a plurality of air inlet window 482B-1 located at or adjacent the venturi region, and a separate light window 482B-3 located downstream of the venturi region. In the open position of the barrel, one of the windows 482B-1 is also aligned with the air nipple 464 of the jet body, and the window 482B-3 is aligned with the light receptacle nipple 468. Thus, in the open position (FIG. 6B) of the barrel/ escutcheon assembly 480, water, air and light are all passed into the interior chamber of the barrel. From the tub interior, the jet assembly is lighted with light passing into the barrel and visible through the center opening of the escutcheon and the escutcheon itself if transparent.

The closed position of the barrel/escutcheon assembly 450 is illustrated in FIG. 6A, with the barrel openings 482B-1 and 482B-3 rotated 90 degrees counterclockwise from the closed position, and window 482B-3 is out of alignment with the corresponding nipple 464 and 468. In this closed position, airflow is reduced since an air window is not directly aligned with the air port, and the opaque barrel prevents light from passing into the interior of the barrel, substantially turning off or attenuating visible light paths from the light source 90 into the barrel. Water flow is unimpeded, and would be controlled in this example by a separate valve or by turning the water pump on/off.

In each of the embodiments discussed above, the light nipple formed on the jet body is short enough to permit installation of the jet body through the tub wall opening, and to allow the fixing nut to fit over the nipple and engage the threads on the outer surface of the jet body.

The jet assembly may include features such as a rotating or stationary eyeball, two-hole spinner and/or a wagon wheel spinner not specifically illustrated in the drawings, and may be fabricated of a transparent material to allow more light to be seen by the spa user, or of an opaque material to provide a glow effect of illumination by the light source 90.

Figure 8:
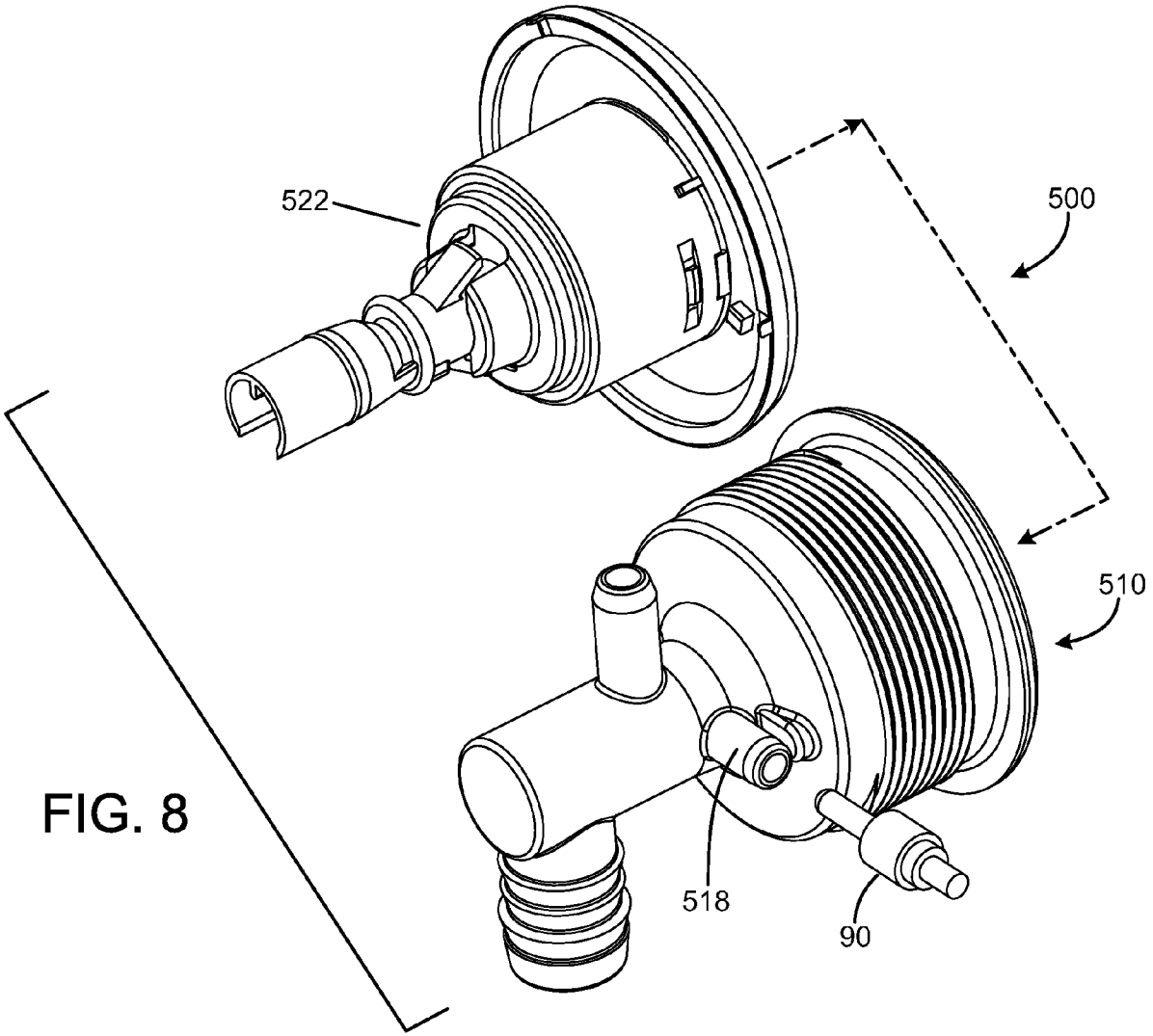
FIG. 8 is an exploded isometric view of a sixth exemplary embodiment of a lighted jet assembly for a bathing installation.
Figure 9:
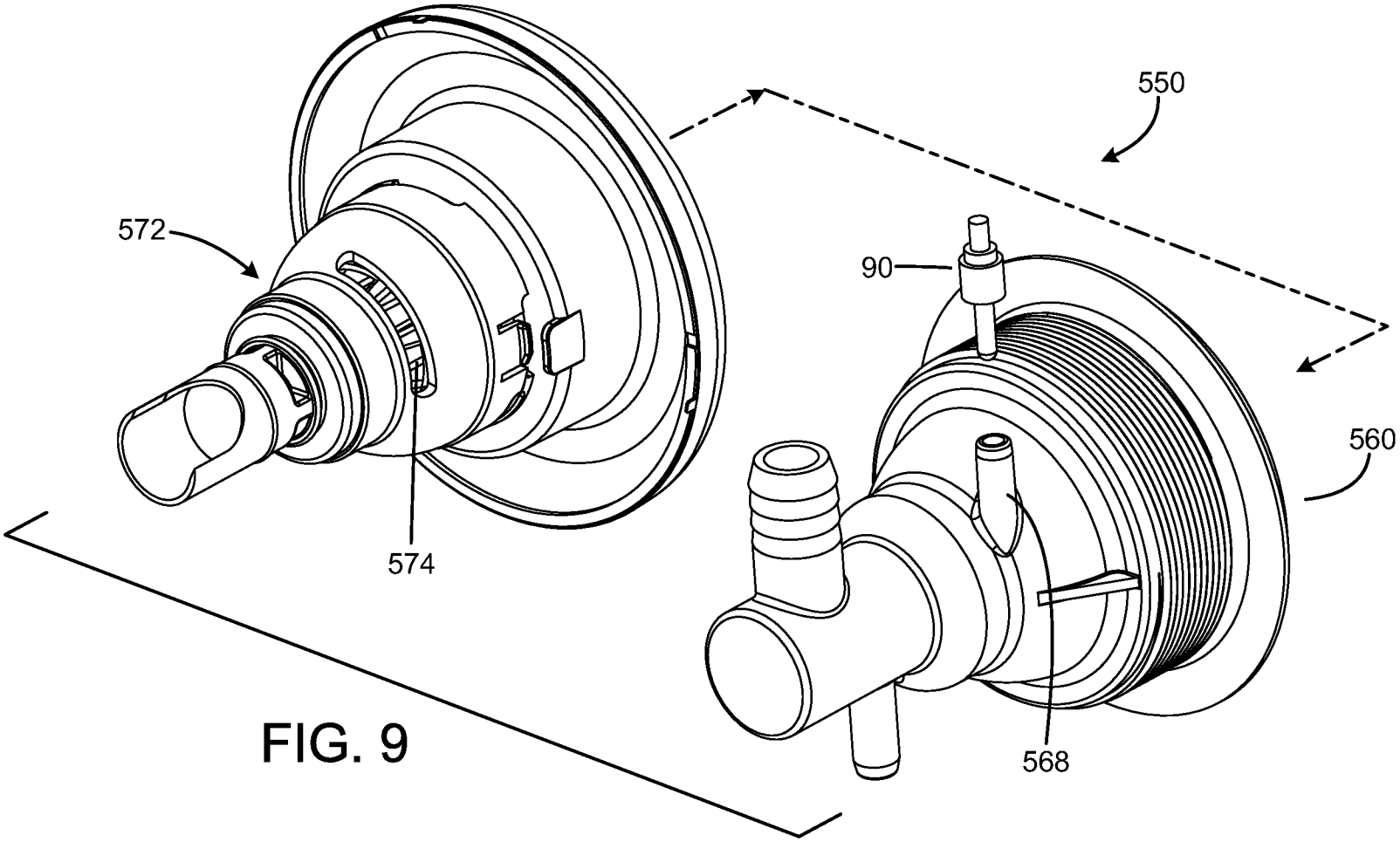
FIG. 9 is an exploded isometric view of a seventh exemplary embodiment of a lighted jet assembly for a bathing installation.
Figures 10A, 10B:
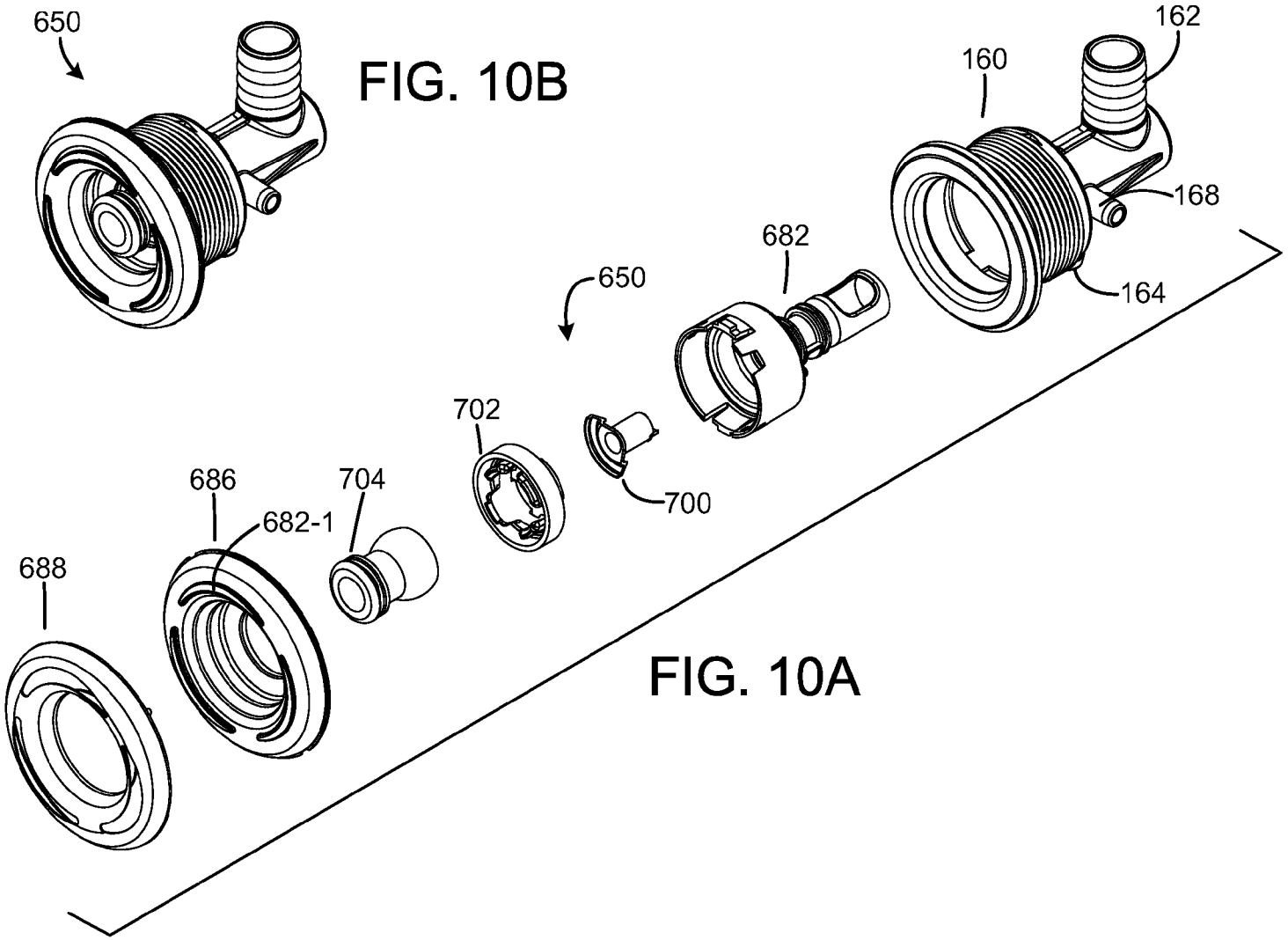
FIG. 10A is an exploded isometric view of an eight exemplary embodiment of a lighted jet assembly.
FIG. 10B is an isometric view of the lighted jet of FIG. 10A in a fully assembled condition.

Other combinations of water/air/light control are also contemplated by aspects of the invention. For example, the barrel/escutcheon assembly may not be configured for rotation. In this example, the jet barrel may be fabricated of a transparent or translucent material, to allow light from a light source 90 mounted in a jet body receptacle as shown in any of the foregoing embodiments to illuminate the jet at all times the light source is activated. FIG. 8 illustrates an exemplary jet assembly 500 in which the barrel structure 522 is fabricated of a transparent or translucent material, so that light emitted from source 90 in light receptacle 518 of the jet body 510 passes into the barrel 522 at all times the light source is activated. The same result can also be obtained with an opaque barrel with a stationary window facing the light source. Or with an elongated window in a rotatable opaque barrel, the jet would be lighted at all times the window faces the light source. FIG. 9 illustrates an exemplary jet assembly 550, in which the window 574 formed in the opaque barrel structure 572 is elongated, so that light emitted from a light source 90 in receptacle 568 of jet body 560 will pass through the window 572 at a range of rotational positions of the barrel in the jet body. This would still provide the advantage of jet illumination without requiring additional elements protruding from or entering the back of the jet assembly. Alternatively, the barrel/escutcheon assembly may be rotatable as described above, with the barrel structure fabricated of a translucent or transparent material, thus allowing light to enter the barrel structure at all times the light source 90 is activated. Yet another alternative is to provide opaque blocking regions on the barrel fabricated of a transparent material in the location facing the light nipple in a closed position. Further, the jet body could be fabricated of an opaque material, with a closed transparent material defined at the base of the light receptacle, e.g. by filling a hole formed in the jet body with a transparent material.

Figure 7:
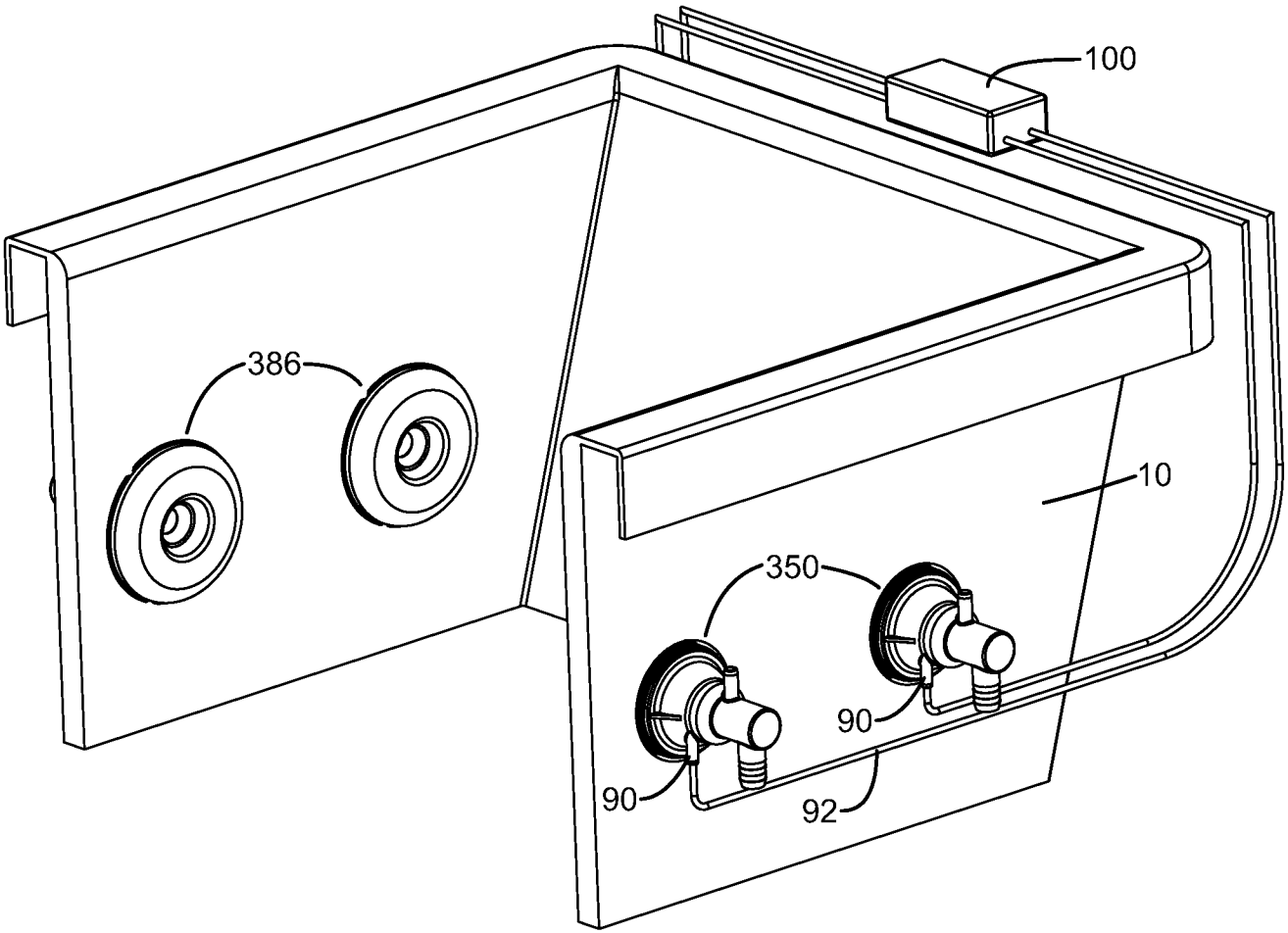
FIG. 7 is a diagrammatic view illustrating a bathing installation tub with a plurality of lighted jets.

FIG. 7 is a diagrammatic illustration of a bathing installation using a plurality of exemplary jet assemblies 350 mounted in the tub wall 10, and connected to a common light controller 100 by wires or fibers 92. The escutcheons 386 are configured for the user to rotate as described above regarding FIGS. 4A-4B.

Another embodiment of a lighted jet assembly 650 for a bathing installation is illustrated in FIGS. 10A-13B. This embodiment provides a light dimming feature, by use of a blind structure 700. The jet assembly includes a jet body 160, which may be the same as the jet body of the embodiment of FIGS. 3A-3B, with a water inlet nipple 162, an air inlet nipple 164 and a light receptacle nipple 168. The light receptacle 168 is located downstream of the air inlet 164. The jet body 160 may be formed of a transparent or translucent material. As shown in the exploded view of FIG. 10A, the exemplary embodiment of the assembly 650 includes the jet body 160, the barrel 682, the blind structure 70, an eyeball retainer 702 (which may alternatively be a bearing structure for a spinning feature), an eyeball 704 (typically fabricated of a transparent material), an escutcheon 686 and optional metal or opaque cover 688. The escutcheon 686 may be fabricated of an opaque, translucent or clear/transparent material, with openings 682-1 formed in the escutcheon to indicate open/close jet position directions.

The jet barrel structure 682 is similar to the corresponding structure 182 of the embodiment of FIGS. 3A-3B. The barrel structure 682 includes an air port 682B-1 (FIG. 13A) and a water port 682C-1, which selectively admit air and/or water into the jet in dependence on the rotational portion of the jet barrel within the jet body, i.e. as the respective air window and/or water window in the jet barrel is aligned with the air port 164 and/or water port 162 of the jet body. In this respect, the jet assembly 650 functions in a manner similar to the assembly 150 of FIGS. 3A-3B. However, the jet barrel 82 is fabricated of a transparent or translucent material, instead of an opaque material. Thus, light emitted by a light source in the light receptacle 168 will pass into the jet barrel structure 682, and would illuminate the barrel structure. Since the jet barrel structure is translucent or clear, there is no need for a separate light window in the barrel structure, such as the light port opening 182B-3 of the embodiment of FIGS. 3A-3B. In the absence of the blind structure 700, the barrel structure will be illuminated at all times the light source is activated. If the escutcheon is opaque, only the eyeball will be illuminated. If the escutcheon is transparent or translucent, then it will be illuminated as well.

The blind structure 700 is shown in detail in FIGS. 12A-13B, and includes a hollow, opaque cylindrical portion 700B having at one end a flange portion 700A. The blind structure 700 may be fabricated as a unitary one-piece structure, from an opaque plastic material, in an exemplary embodiment. In this embodiment, the flange portion is opaque, and is a partial or sector portion, extending over an angular sector extent on the order of 70 degrees or so. The angular sector extent of the blind 70 could be larger or smaller for a given embodiment, depending on the amount of light dimming desired for the particular embodiment. The angular sector extent could range from 20 degrees to 180 degrees, for example. The opposite end of the cylindrical portion 700B for this exemplary embodiment includes a protruding rib portion 700D and a tab portion 700C. The tab portion has only a partial circumferential extent. The blind structure 700 is configured for a snap-in into the jet barrel 682, with the rib portion 700D entering the top part of the air window 682B-1 (FIG. 13A) and locking against the window frame portion 682B-1A to hold the blind structure in place in the barrel 682. The tab portion 700C also extends into the air window of the barrel, but in this embodiment the window is much wider than the width of the tab portion 700C, so that the tab portion does not significantly block air from moving through the air window into the barrel. The rib 700D and tab portion 700C of the blind 700 are visible in FIG. 13B in position relative to the air window 682B-1 of the barrel 682. Other techniques may be employed to secure the blind structure to the barrel structure, including adhesive, small finger or barb portions which extend over the rim of the opening 682B-1 of the barrel 682, and interference fit, by way of example only.

Figure 11B:
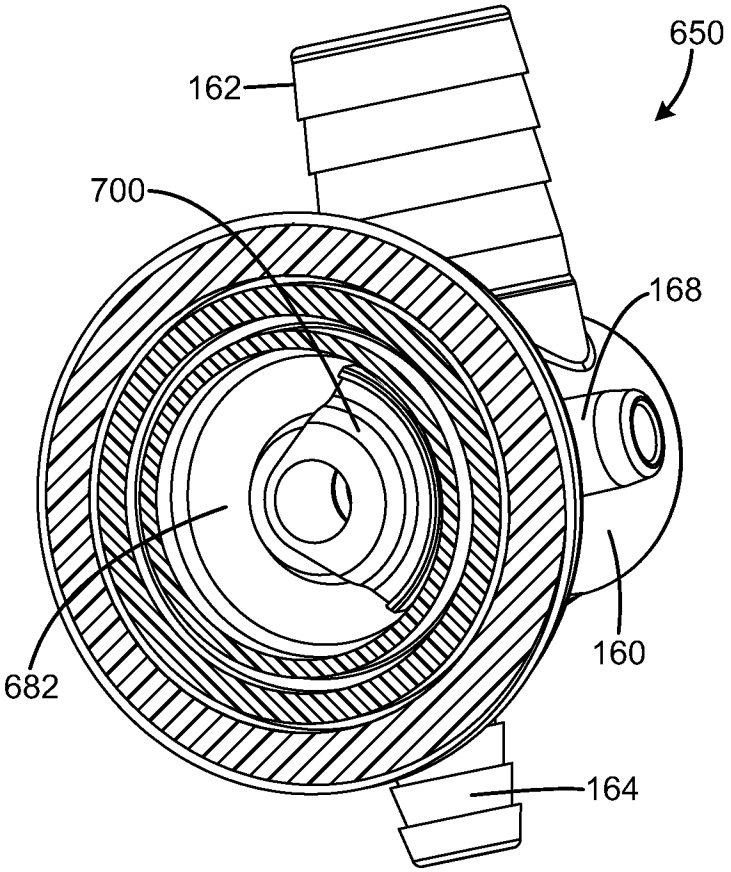
FIG. 11B is a view similar to FIG. 11A, but showing the blind structure in a light dimming position.
Figure 11A:
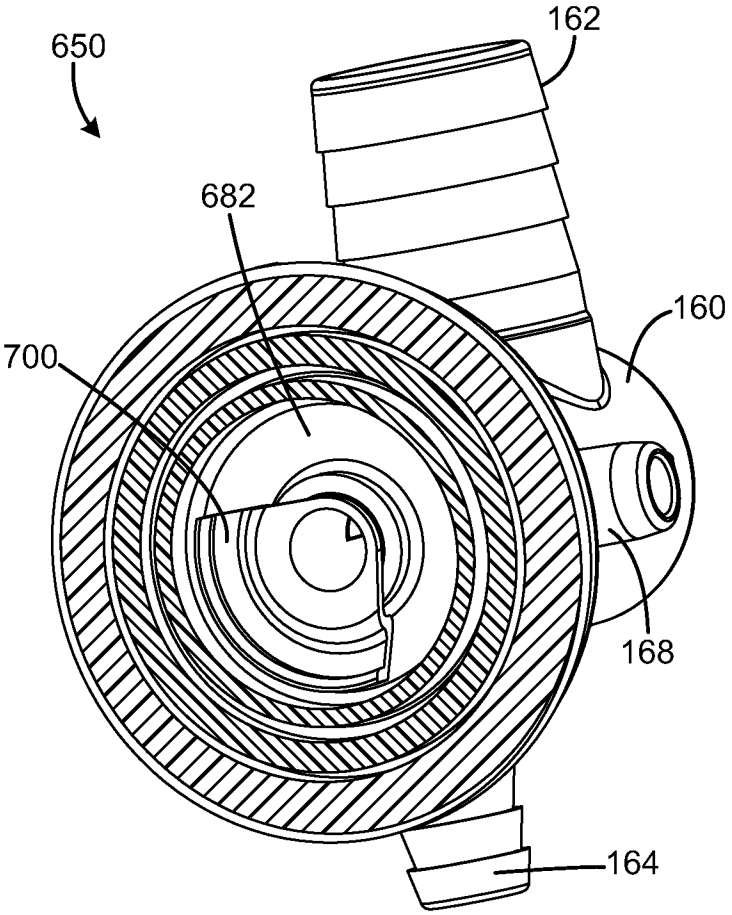
FIG. 11A is a front isometric view of the lighted jet assembly of FIGS. 10A-10B, showing a blind structure in a full light position.
Figure 13B:
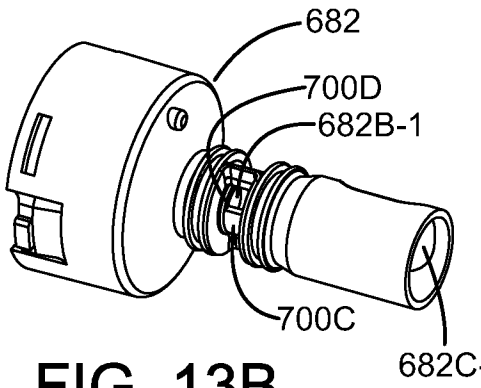
FIGS. 13A-13B are similar views, but taken generally from a right rear orientation.
Figure 13A:
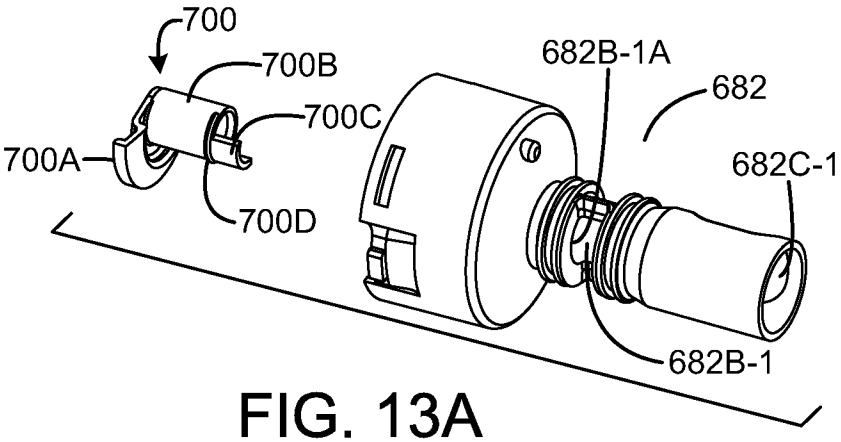
Figure 12B:
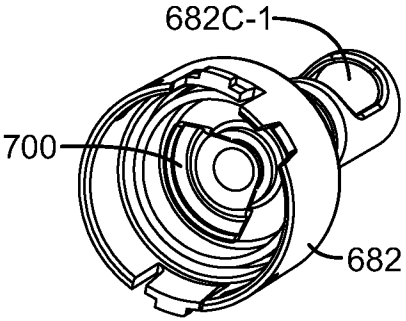
FIGS. 12A-12B are respective exploded and assembled isometric views of an exemplary embodiment of a barrel structure and blind structure for a lighted jet assembly, taken generally from a right front orientation.
Figure 12A:
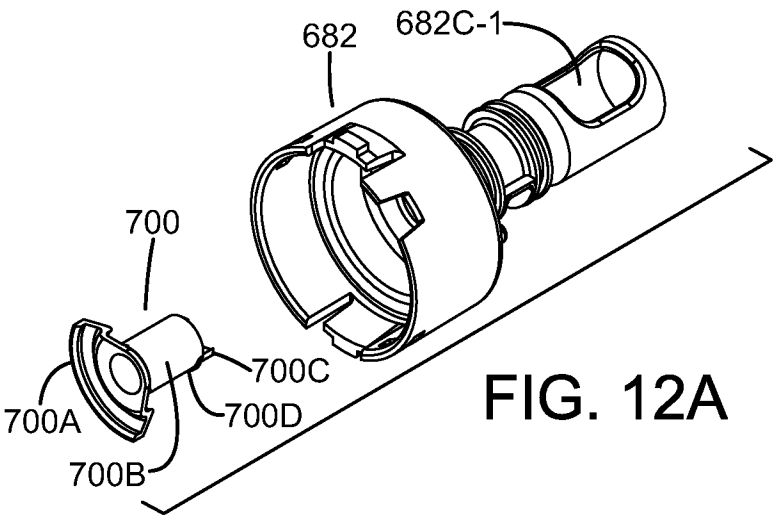

In this embodiment, the rotational position of the jet barrel and blind structure in a light-dimming position places the opaque tab portion 700C in alignment with the light source in the light receptacle 168 of the jet body and the flange portion over, but spaced from, the light receptacle, in a viewing direction of a user looking at the jet assembly, e.g. from the perspective of FIGS. 11A and 11B. The cylindrical body portion 700D, the flange portion 700B and the tab portion 700D thus block a substantial amount of light generated by the light source from entering into the interior opening of the jet barrel 682. The dimming position of the jet body and blind structure is illustrated in FIG. 11B, which shows the jet barrel and blind structure assembled to the jet body 160. In the dimming position, the water port of the barrel is not aligned with the water port 162, so that jet water flow is substantially turned off, with the dimmed light effect indicating the off status of the jet. FIG. 11A illustrates the full illumination position of the barrel and blind structure within the jet body. In this position, the tab portion 700C of the blind structure has been rotated away from the light receptacle 168, allowing light from the light source to enter into the jet barrel and illuminate jet features. In this position, the water port of the barrel is aligned with the water inlet port 162 of the jet body, so that water flows through the jet assembly.

The particular size of the flange portion 700A, as well as that of the tab portion 700C, may be varied to adjust to the particular jet configuration. The tab portion 700C may even be eliminated for some applications, with the light blocking done entirely with the opaque cylindrical portion 700B and flange portion 700A. In this case, the blind structure may include fingers which grab the window frame portion 682B-1A to hold the blind structure in place in the barrel 682.

To rotate the barrel and blind structure, the user rotates the escutcheon 686.

While the blind structure position is timed from the air window of the barrel in this exemplary embodiment, the blind position may alternatively be timed off another barrel feature such as an indentation or hole in the barrel.

Although the foregoing has been a description and illustration of specific embodiments of the subject matter, various modifications and changes thereto can be made by persons skilled in the art without departing from the scope and spirit of the invention.

What is claimed is:

1. A lighted jet assembly for through hole mounting to a panel in a bathing installation, comprising:

a jet body configured for mounting in a hole formed in the bathing installation panel, the jet body including a water inlet port formed at or adjacent a first end of the jet body and a flange portion formed at an open second end of the jet body, the jet body defining a jet body channel and a water flow path from the water inlet port to the second end of the jet body;

an air inlet nipple and a light receptacle formed integrally with the jet body outside of the water flow path, the air inlet nipple configured for attachment to an air source, the light receptacle sealed from the water flow path and configured to receive a light source element without interference with the water flow path within the jet body;

a jet barrel assembly including a hollow barrel structure configured for insertion into the jet body channel through said open second end of the jet body, the jet barrel structure fabricated of a transparent or translucent material and including an open interior region, the jet barrel assembly configured for rotation within the jet body and including a water inlet window and an air inlet window;

the jet body and the jet barrel assembly providing a light path between the light receptacle and at or adjacent the second end of the jet body;

a blind structure including a hollow cylindrical portion having at a first end a flange portion extending over a limited angular extent, and a second end configured to be secured within the open interior region of the jet barrel structure, the blind structure fabricated of an opaque material, and configured for rotation with the jet barrel assembly relative to the jet body, so that in a light-dimming rotational position, the flange portion of the blind structure is aligned over the light receptacle of the jet body so that the flange portion and cylindrical portion block a substantial amount of light passing through the jet barrel, and in a full illumination rotational position, the flange portion of the blind structure is positioned away from the light receptacle allowing light from the receptacle to pass through the jet barrel and be visible to observers to provide an illumination effect, and wherein the blind structure is a separate structure from the jet barrel assembly.

2. The jet assembly of claim 1, wherein the jet body is fabricated from a translucent or transparent material, so that light from the light source element in the light receptacle passes through the jet body.

3. The jet assembly of claim 1, wherein the water inlet window of the barrel structure is configured to align with the water inlet port of the jet body with the barrel structure in said illumination rotational position, and wherein said barrel structure blocks water from flowing into the interior region of the barrel structure with the barrel structure in the light-dimming rotational position, wherein rotation of the barrel structure controls the flow of water and air through the jet assembly, and also controls the amount of light transmitted into the interior region of the barrel structure.

4. The jet assembly of claim 1, wherein the jet barrel assembly includes an escutcheon attached to an end of the barrel structure, and the jet barrel assembly is rotatable within the jet body by manual rotation of the escutcheon.

5. The jet assembly of claim 1, further comprising:

the light source positioned within the light receptacle, the light source comprising one of an LED, an optical fiber and an incandescent bulb.

6. A lighted jet assembly for through hole mounting to a panel in a bathing installation, comprising:

a jet body having a longitudinal axis and configured for mounting in a hole formed in the bathing installation panel, the jet body fabricated of a transparent or translucent material and including a water inlet port formed at or adjacent a first end of the jet body and a flange portion formed at an open second end of the jet body, the jet body defining a jet body channel, a jet body wall between the first end and the second end, and a water flow path from the water inlet port to the second end of the jet body;

an air inlet formed integrally with the jet body, the air inlet configured for attachment to an air source;

a receptacle formed in the jet body wall outside of the water flow path and angularly offset from the jet body longitudinal axis, the receptacle sealed from the water flow path and configured to receive a light source structure without interference with the water flow path within the jet body;

a jet barrel structure including a hollow barrel structure configured for insertion into the jet body channel through said open second end of the jet body, the jet barrel structure including an open interior region;

wherein the jet barrel structure is configured for rotation within the jet body and includes a water inlet window and an air inlet window;

the jet body and the jet barrel assembly providing a light path between the receptacle and at or adjacent the second end of the jet body;

the jet assembly further comprising:

a blind structure including a hollow cylindrical portion having at a first end a flange portion extending over a limited angular extent, and a second end configured to be secured within the open interior region of the jet barrel structure, the blind structure fabricated of an opaque material, and configured for rotation with the jet barrel assembly relative to the jet body, so that in a light-dimming rotational position, the flange portion of the blind structure is aligned over the light receptacle of the jet body so that the flange portion and cylindrical portion block a substantial amount of light passing through the jet barrel, and in a full illumination rotational position, the flange portion of the blind structure is positioned away from the light receptacle allowing light from the receptacle to pass through the jet barrel and be visible to observers to provide an illumination effect; and wherein the blind structure is a separate structure from the jet barrel assembly.

7. The jet assembly of claim 6, wherein the receptacle is diposed downstream of the air inlet relative to the jet body longitudinal axis.

8. The jet assembly of claim 6, further comprising:

the light source structure secured to the receptacle, and wherein the jet body is illuminated by the light source structure at all times the light source structure is activated.

9. The jet assembly of claim 8, wherein the light source structure comprises a light source element consisting of one of an LED, an optical fiber and an incandescent bulb.

10. The jet assembly of claim 6, wherein the receptacle includes a nipple extending from the jet wall and configured to receive a light source element.

11. The jet assembly of claim 10, wherein the nipple is integrally formed with the jet body.

12. The jet assembly of claim 11, wherein the nipple extends outwardly away from and perpendicular to the jet wall.

13. A lighted jet assembly for through hole mounting to a panel in a bathing installation, comprising:

a jet body having a longitudinal axis and configured for mounting in a hole formed in the bathing installation panel, the jet body fabricated of a transparent or translucent material and including a water inlet port formed at or adjacent a first end of the jet body and a flange portion formed at an open second end of the jet body, the jet body defining a jet body channel, a jet body wall between the first end and the second end, a threaded region, and a water flow path from the water inlet port to the second end of the jet body;

a threaded nut configured to be threaded onto the threaded region of the jet body to secure the flange portion tightly against the panel;

an air inlet formed integrally with the jet body, the air inlet configured for attachment to an air source;

a receptacle formed in the jet body wall outside of the water flow path and angularly offset from the jet body longitudinal axis, the receptacle sealed from the water flow path and configured to receive a light source structure without interference with the water flow path within the jet body;

a jet barrel structure including a hollow barrel structure configured for insertion into the jet body channel through said open second end of the jet body, the jet barrel structure including an open interior region;

wherein the jet barrel structure is configured for rotation within the jet body and includes a water inlet window and an air inlet window, and wherein the jet body and the jet barrel structure provide a light path between the light receptacle and at or adjacent the second end of the jet body, the jet assembly further comprising:

a blind structure including a hollow cylindrical portion having at a first end a flange portion extending over a limited angular extent, and a second end configured to be secured within the open interior region of the jet barrel structure, the blind structure fabricated of an opaque material, and configured for rotation with the jet barrel assembly relative to the jet body, so that in a light-dimming rotational position, the flange portion of the blind structure is aligned over the light receptacle of the jet body so that the flange portion and cylindrical portion block a substantial amount of light passing through the jet barrel, and in a full illumination rotational position, the flange portion of the blind structure is positioned away from the light receptacle allowing light from the receptacle to pass through the jet barrel and be visible to observers to provide an illumination effect; and wherein the blind structure is a separate structure from the jet barrel assembly.

14. The jet assembly of claim 13, further comprising:

the light source structure secured to the receptacle, and wherein the jet body is illuminated by the light source structure at all times the light source structure is activated.

15. The jet assembly of claim 13, wherein the receptacle includes a nipple extending from the jet wall.

16. The jet assembly of claim 15, wherein the nipple is integrally formed with the jet body.

* * * * *